US009463465B2

(12) United States Patent
Castronovo

(10) Patent No.: US 9,463,465 B2
(45) Date of Patent: Oct. 11, 2016

(54) COMPACT HIGH-SECURITY DESTRUCTION MACHINE

(71) Applicant: Charles A. Castronovo, Middle River, MD (US)

(72) Inventor: Charles A. Castronovo, Middle River, MD (US)

( * ) Notice: Subject to any disclaimer, the term of this patent is extended or adjusted under 35 U.S.C. 154(b) by 645 days.

(21) Appl. No.: 13/826,585

(22) Filed: Mar. 14, 2013

(65) Prior Publication Data

US 2014/0061340 A1 Mar. 6, 2014

Related U.S. Application Data

(60) Provisional application No. 61/697,776, filed on Sep. 6, 2012.

(51) Int. Cl.

| | |
|---|---|
| ***B02C 19/00*** | (2006.01) |
| ***B02C 18/00*** | (2006.01) |
| ***B02C 18/14*** | (2006.01) |
| ***B02C 18/22*** | (2006.01) |
| *B02C 18/16* | (2006.01) |
| *B02C 23/16* | (2006.01) |

(52) U.S. Cl.

CPC ..... *B02C 19/0056* (2013.01); *B02C 18/0007* (2013.01); *B02C 18/148* (2013.01); *B02C 18/2283* (2013.01); *B02C 2018/0015* (2013.01); *B02C 2018/0046* (2013.01); *B02C 2018/164* (2013.01); *B02C 2023/165* (2013.01)

(58) Field of Classification Search

CPC ..... B02C 19/0056; B02C 2018/0015; B02C 2023/165; B02C 13/282; B02C 13/284; B02C 18/186; B02C 19/20; B02C 23/00; B02C 9/02; B24D 3/28; B24D 99/00; B44B 5/00

USPC ..... 241/36, 101.2, 100, 277

See application file for complete search history.

(56) References Cited

U.S. PATENT DOCUMENTS

| | | | | |
|---|---|---|---|---|
| 221,371 | A * | 11/1879 | Stevens | B02C 18/186 241/241 |
| 1,392,054 | A | 9/1921 | Herron | |
| 1,666,640 | A | 4/1928 | Liu | |
| 1,874,902 | A | 8/1932 | Clyne | |
| 2,265,449 | A | 12/1941 | Radulescu | |
| 2,265,649 | A | 12/1941 | Krehbiel | |
| 2,331,597 | A | 10/1943 | Coles | |
| 2,558,255 | A | 6/1951 | Johnson | |
| 2,974,883 | A * | 3/1961 | Engel | B02C 13/282 241/17 |
| 3,031,982 | A | 5/1962 | Gordon | |
| 3,175,594 | A | 3/1965 | Jensen | |
| 3,195,592 | A | 7/1965 | Hall | |
| 3,363,847 | A | 1/1968 | Goa | |
| 3,396,914 | A | 8/1968 | Liebman | |
| 3,527,416 | A | 9/1970 | Detjen | |
| 3,529,777 | A | 9/1970 | Dodson | |
| 3,589,276 | A | 6/1971 | Swallert | |
| 3,620,461 | A | 11/1971 | Pelleschi | |
| 3,622,090 | A | 11/1971 | Liebman | |
| 3,762,256 | A | 10/1973 | Frantz | |
| 3,825,194 | A | 7/1974 | Buell | |
| 3,873,047 | A | 3/1975 | Johnson | |
| 3,936,004 | A | 2/1976 | Graf | |
| 3,948,026 | A | 4/1976 | Whitechester | |

(Continued)

*Primary Examiner* — Mark Rosenbaum

(74) *Attorney, Agent, or Firm* — Whitham, Curtis & Cook, P.C.

(57) ABSTRACT

A small-form-factor high-security destruction machine for optical media has a weight empty of about 16.3 lbs. and holds about 5 lbs. of residue.

11 Claims, 10 Drawing Sheets

(56) References Cited

U.S. PATENT DOCUMENTS

| | | | | |
|---|---|---|---|---|
| 3,986,676 | A | 10/1976 | Husmann | |
| 4,056,107 | A | 11/1977 | Todd | |
| 4,068,805 | A | 1/1978 | Oswald | |
| 4,124,169 | A | 11/1978 | Hatanaka | |
| 4,200,239 | A | 4/1980 | Simone | |
| 4,204,448 | A | 5/1980 | Pearl | |
| 4,226,372 | A | 10/1980 | Wigand | |
| 4,226,377 | A | 10/1980 | Shelton | |
| 4,231,530 | A | 11/1980 | Hatanaka | |
| 4,236,463 | A | 12/1980 | Westcott | |
| 4,259,562 | A | 3/1981 | Cammann | |
| 4,269,584 | A | 5/1981 | Kroll | |
| 4,351,484 | A * | 9/1982 | Hart | B02C 19/0056 241/277 |
| 4,355,766 | A | 10/1982 | Wigand | |
| 4,509,700 | A | 4/1985 | Svengren | |
| 4,557,421 | A | 12/1985 | Probst | |
| 4,558,827 | A | 12/1985 | Berger | |
| 4,659,025 | A | 4/1987 | Tjumanok | |
| 4,664,317 | A | 5/1987 | Morton | |
| 4,721,259 | A | 1/1988 | Shagarova | |
| 4,736,897 | A | 4/1988 | Reemet | |
| 4,799,625 | A | 1/1989 | Weaver | |
| 4,801,101 | A | 1/1989 | Dreyer | |
| 4,813,619 | A | 3/1989 | Tjumanok | |
| 5,016,828 | A | 5/1991 | Utsumi | |
| 5,065,947 | A | 11/1991 | Farnsworth | |
| 5,076,503 | A | 12/1991 | Cook | |
| 5,284,433 | A | 2/1994 | Cates | |
| 5,313,864 | A | 5/1994 | Forgash | |
| 5,320,287 | A | 6/1994 | Li | |
| 5,340,034 | A | 8/1994 | Jang | |
| 5,375,781 | A | 12/1994 | Schwelling | |
| 5,439,181 | A | 8/1995 | Williams | |
| 5,445,054 | A | 8/1995 | Pryor | |
| 5,678,774 | A | 10/1997 | Bennett | |
| 5,697,560 | A | 12/1997 | Bennett | |
| 5,772,129 | A | 6/1998 | Nishio | |
| 5,806,418 | A | 9/1998 | Dillinger | |
| 5,833,380 | A | 11/1998 | Hosomi | |
| 5,947,395 | A | 9/1999 | Peterson | |
| 5,954,569 | A | 9/1999 | Hutchison | |
| 5,975,445 | A | 11/1999 | Ko | |
| 5,988,542 | A | 11/1999 | Henreckson | |
| 5,997,560 | A | 12/1999 | Miller | |
| 6,079,645 | A | 6/2000 | Henreckson | |
| 6,152,050 | A | 11/2000 | Tsantrizos | |
| 6,189,446 | B1 | 2/2001 | Olliges | |
| 6,334,582 | B1 | 1/2002 | Castronovo | |
| 6,450,427 | B1 | 9/2002 | Maynard | |
| 6,550,701 | B1 | 4/2003 | Chang | |
| 6,561,444 | B1 | 5/2003 | Yokomine | |
| 6,564,685 | B1 | 5/2003 | Beaton | |
| 6,575,389 | B2 | 6/2003 | Neely | |
| 6,585,177 | B2 | 7/2003 | Castronovo | |
| 6,588,687 | B2 | 7/2003 | Castronovo | |
| 6,588,688 | B1 | 7/2003 | Rossler | |
| 6,679,444 | B2 | 1/2004 | Castronovo | |
| 6,685,119 | B2 | 2/2004 | Castronovo | |
| 6,820,830 | B1 | 11/2004 | Lassen | |
| 6,938,844 | B2 | 9/2005 | Castronovo | |
| 6,983,903 | B2 | 1/2006 | Chang | |
| 7,090,156 | B2 | 8/2006 | Castronovo | |
| 7,090,214 | B2 | 8/2006 | Castronovo | |
| 7,100,852 | B2 | 9/2006 | Castronovo | |
| 7,111,801 | B2 | 9/2006 | Castronovo | |
| 7,128,285 | B2 | 10/2006 | Fujita | |
| 7,175,116 | B2 | 2/2007 | Castronovo | |
| 7,204,436 | B2 | 4/2007 | Castronovo | |
| 7,240,864 | B2 | 7/2007 | Castronovo | |
| 7,267,294 | B2 | 9/2007 | Castronovo | |
| 7,270,282 | B2 | 9/2007 | Castronovo | |
| 7,334,747 | B2 | 2/2008 | Castronovo | |
| 7,357,340 | B2 | 4/2008 | Castronovo | |
| 7,424,981 | B2 | 9/2008 | Castronovo | |
| 7,427,040 | B2 | 9/2008 | Castronovo | |
| 7,448,562 | B2 | 11/2008 | Castronovo | |
| 7,500,625 | B2 | 3/2009 | Castronovo | |
| 7,600,705 | B2 | 10/2009 | Castronovo | |
| 7,607,598 | B2 | 10/2009 | Castronovo | |
| 7,871,025 | B2 | 1/2011 | Castronovo | |
| 8,100,353 | B2 | 1/2012 | Castronovo | |
| 8,292,204 | B2 | 10/2012 | Castronovo | |
| 8,297,544 | B2 | 10/2012 | Castronovo | |
| 8,408,484 | B2 | 4/2013 | Castronovo | |
| 2010/0327092 | A1 * | 12/2010 | Romanovich | B02C 18/0007 241/25 |

* cited by examiner

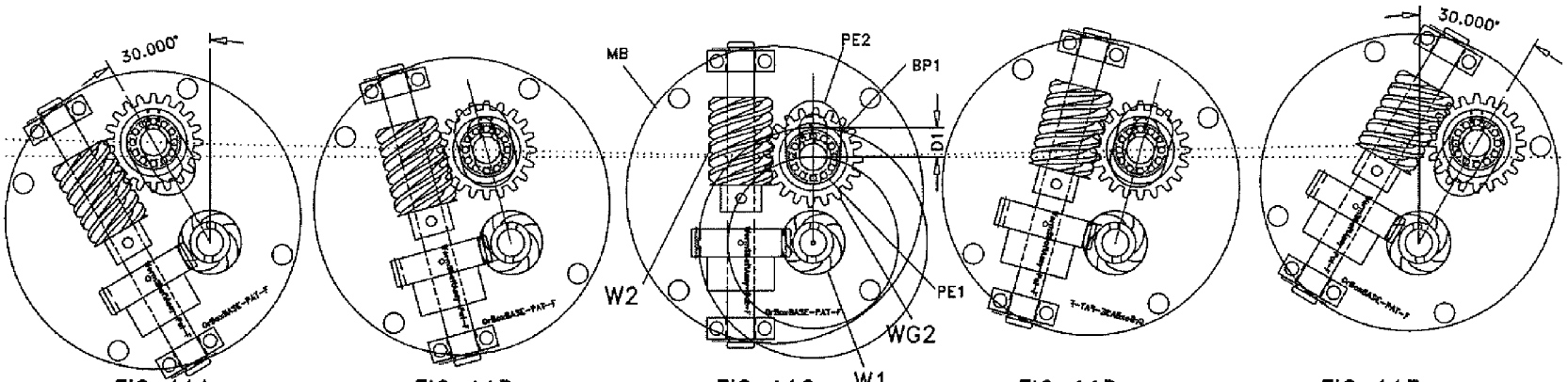
FIG 11A
FIG 11B
FIG 11C
FIG 11D
FIG 11E
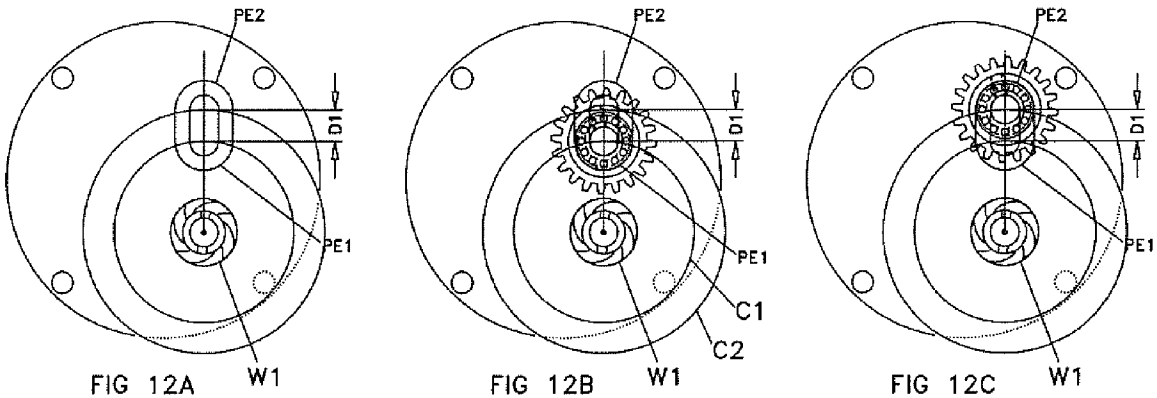
FIG 12A
FIG 12B
FIG 12C NO
NC
COM
F-->
20
21
27
28
15
26
12
D
14
25
24
8
9A
2
29
30
34A
34B
5
31
11
32
33

COMPACT HIGH-SECURITY DESTRUCTION MACHINE

FIELD OF THE INVENTION

The present invention generally relates to material destruction, especially to high-security destruction and security destruction machines.

BACKGROUND OF THE INVENTION

Certain machines exist for accomplishing "high-security" destruction of various materials such as, for example, paper, optical media (such as Compact Disks and DVD's) and Cryptographic Key Tape. We use the term "high-security" herein as used in the shredder industry and as used by the United States National Security Agency (NSA) which promulgates specifications and standards by which machines are measured for whether or not they accomplish "high-security" destruction of an input material. In 2005, NSA revised its specifications for high-security optical media destruction in a direction of requiring specific residue particle size, and we refer to those newer specifications requiring the smaller residue size as the NSA/CSS 04-02-A of 15 Jul. 2005 ("CSS" refers to the Central Security Service within NSA) specifications for "high-security" Optical Media destruction. This Standard remains in full force and effect as of March, 2013. This Standard has many requirements, including requirements for differing types of destruction processes. For whole-disk destruction, this Standard requires (in brief, and only summarized herein regarding particle sizes) that:

a) No particle shall have an edge dimension exceeding 7.0 mm b) 90% of particles (by mass) shall have no edge dimension exceeding 5.0 mm c) No particle shall have an area exceeding 35 square mm d) 90% of particles (by mass) shall have an area not exceeding 25 square mm e) Unseparated particles shall not exceed 2% (by mass)

f) The number of connected particles may not exceed 5 (in any connected group of particles).

Generally speaking, machines that in the industry are called "disintegrators" and that weigh hundreds of pounds are able to accomplish high-security shredding by a system of rotary cutting blades and certain screens. A conventional disintegrator has 2, 3 or even 5 individual blades mounted on a heavy drum, and the rotating blades closely approach bed blades, with the exit path from the cutting system of rotating blades and bed blades blocked by a screen, which prevents particles over a certain size (determined mostly by the size of the holes in the screen) from exiting the system for ordinary disposal. A human operator drops to-be-destroyed material into the disintegrator, and the material freely falls into the area of the rotating blades. The rotating blades randomly chop material against the bed blades until the particles are chopped small enough to pass through the exit screen.

The industry also provides Optical shredding machines, similar in basic design to paper shredders, but with much thicker and stronger cutting components (Optical Media being much more difficult than paper to chop) and outputting larger-than-for-paper particle sizes. Such machines are often called "Optical Media shredders".

Meanwhile, there are other commercially available shredder and disintegrator machines that process optical media but only into big chunks, not necessarily to satisfy NSA/CSS 04-02-A high-security specifications. A machine that weighs about 150 pounds, selling for about $2,500, shreds optical media into what those in the high-security industry consider to be big chunks. The openings in the screens in conventional commercially available disintegrators are only so small, because if the screen openings were to be made smaller, the throughput would be unacceptable.

There are some relatively new machines able to accomplish high-security destruction of optical media to NSA/CSS 04-02-A specifications, but in a machine much smaller than a conventional "disintegrator". These small machines for high-security destruction according to NSA/CSS 04-02-A specifications includes DataStroyer® machines (sold by Whitaker Brothers under license) and, more recently, InfoStroyer® machines (sold by Applied Magnetics Laboratory) embodying patented technology invented by Charles Castronovo. DataStroyer® machines are popular with niche customers who want to only physically destroy the data on a CD to a high-security level but want to keep the CD itself with its center ring identification number; some customers prefer for the whole disk, and not just the data layer to be completely shredded or have a disk that is broken or not size-compatible with a DataStroyer®. InfoStroyer® high-security machines have been well-received especially by certain customers who required the small-particle-size and small machine size with high-security destruction, but these machines comprise certain necessary parts (such as, e.g., a main zero-clearance rotary cutter; a motorized sacrificial blade system; a secondary cutting gauntlet; a set of two pinch rollers) each of which substantially contributes to machine cost.

SUMMARY OF THE INVENTION

The invention in a preferred embodiment provides a security destruction machine having a form factor of about 11.5 inches by 9.4 inches, by 7.8 inches, wherein a to-be-destroyed optical media material received into the security destruction machine is entirely destroyed within the security destruction machine into high-security residue as defined by NSA/CSS 04-02-A specifications for high-security destruction of optical media, such as, e.g., an inventive machine comprising a cutter that is of a high-speed burr-like design; an inventive machine comprising a residue collection bin, wherein the security destruction machine has an empty weight, when the residue collection bin is empty, of about 16.3 pounds or less; an inventive machine wherein the intake slot tolerates a continuous feed of successive disks being fed by a human operator; an inventive machine wherein the residue collection bin has a capacity to hold about 5 pounds of optical media residue; an inventive machine comprising a screen (such as, e.g., a screen that is wrapped around the cutter (such as, e.g., wherein the screen is wrapped around the cutter spanning more than 180 degrees of the cutter; wherein the screen is wrapped around the cutter spanning about 280 degrees of the cutter; etc.); an inventive machine wherein the cutter is in a zero-clearance arrangement; an inventive machine comprising a cut bar pivot limit mechanism, wherein the cut bar pivot limit mechanism maintains a zero-clearance arrangement of the cutter; an inventive machine comprising a controlled feeding system; an inventive machine comprising a pinch roller (such as, e.g., a moving pinch roller); an inventive machine comprising a main cutter motor and a vacuum motor; an inventive machine comprising a driven pulley; an inventive machine comprising an integrated ventilation impeller; an inventive machine comprising a 16-tooth burr with a helical diamond pattern thereon; an inventive machine comprising a double reduction worm-gear set; and other inventive machines.

In another preferred embodiment, the invention provides a rotary cutter system, comprising: a high-speed burr-like design and a screen wrapped around the high-speed burr-like cutter without the screen touching the cutter; such as, e.g., an inventive rotary cutter system wherein the wrapped screen has about 15/1,000 of an inch radial clearance from the burr; an inventive rotary cutter system wherein a radial clearance between the wrapped screen and the cutter is in a range of about 5/1,000 to 30/1,000 of an inch; an inventive rotary cutter system wherein the screen is wrapped around the cutter spanning more than 180 degrees of the cutter; an inventive rotary cutter system, wherein the screen is wrapped around the cutter spanning about 270 degrees; and other inventive rotary cutter systems.

In an additional preferred embodiment, the invention provides a screening method in a destruction operation, comprising: wrapping a screen around a rotary cutter (such as, e.g., a patterned cutter; a rotary cutter that is cylindrical shaped; etc.) without the screen touching the rotary cutter; such as, e.g., an inventive screening method wherein the wrapped screen has about 15/1,000 of an inch radial clearance from the rotary cutter; an inventive screening method wherein a clearance in a range of about 5/1,000 to 30/1,000 of an inch is present radially between the wrapped screen and the rotary cutter; and other inventive screening methods.

The invention in a further preferred embodiment provides a security destruction machine comprising: a residue collection bin and having an empty weight of about 16.3 pounds or less when the residue collection bin is empty; and an intake slot into which is received optical media; wherein optical media that is received into the intake slot is processed within the security destruction machine entirely into residue that is high-security residue as defined by NSA/CSS 04-02-A specification for optical media.

The invention in another preferred embodiment provides a security destruction machine comprising a sensor of bin-fullness wherein the sensor is a vacuum-sensing sensor.

In a preferred embodiment, the invention provides a method of sensing bin-fullness of a bin filling with a residue, comprising: while the bin is filling with the residue, operating a sensor in proximity to the bin; and sensing vacuum wherein the vacuum-sensing step is performed by the sensor.

The invention in another preferred embodiment provides a method of tripping a stop-feed condition in connection with fullness of a bin filling with a residue which remains of a material that has been received into an intake slot, comprising: while the bin is filling, operating a sensor that detects whether a back pressure is present; and, when the back pressure is detected by the sensor, tripping a stop-feed state in which the intake slot stops permitting receipt of material therein.

In another preferred embodiment, the invention provides a security destruction machine, comprising an intake slot into which is received optical media that is to be finely cut into residue; a patterned rotary cutter; and, a residue collection bin; such as, e.g., an inventive machine wherein optical media that is received into the intake slot is processed within the security destruction machine entirely into residue that is high-security residue as defined by NSA/CSS 04-02-A specification for optical media; and other inventive machines.

The invention also in another preferred embodiment provides a destruction machine comprising: a cutter; a screen; and, a controlled feed system; such as, e.g., an inventive machine comprising a pinch roller; and other inventive machines.

The invention in a preferred embodiment provides a controlled feed system for a security destruction machine, comprising: a set of sliding ends; a roller shaft held within the set of sliding ends; a set of tight strong springs; and, a pinch roller (such as, e.g., a pinch roller that is a forward-and-back-moving-while rotating pinch roller); such as, e.g., an inventive controlled feed system comprising a set of gears wherein a first gear stays in mesh with a final gear and in mesh with other gears even though an axle is translating laterally; and other inventive controlled feed systems.

In another preferred embodiment, the invention provides a gear assembly comprising: a set of four gears driven off a main shaft, wherein a first driving gear stays constantly in mesh with a driven gear and in constant mesh with the other gears even though a driven axle is translating laterally; such as, e.g., an inventive gear assembly wherein a 100:1 reduction is established; an inventive gear assembly wherein when disposed in relation to a cutter provides positive control relative to speed of the cutter; and other inventive gear assemblies.

The invention in another preferred embodiment provides a security destruction machine comprising: a cutter; a blower; and, a motor; wherein the motor powers the cutter and the blower; such as, e.g., an inventive machine further comprising a pinch roller and a gear system that drives the pinch roller, wherein the motor powers the cutter, the blower and the gear system; and other inventive machines.

In another preferred embodiment, the invention provides an optical media disk security destruction machine that conforms to variability of load including round shape of a disk being shredded, such as, e.g., an inventive machine wherein a machine speed of the security destruction machine varies according to load; and other inventive machines.

The invention in another preferred embodiment provides a security destruction machine comprising a staggered-pattern cutter (such as, e.g., a cutter that has a staggered-pattern that is diamond-cut with two spiral angles).

In another preferred embodiment, the invention provides a security destruction machine comprising a cut bar pivot limit mechanism (such as, e.g., a cut bar pivot limit mechanism that comprises opposing oval holes (such as, e.g., oval holes that are in side plates)); such as, e.g., an inventive machine further comprising a cut bar that undergoes ablated wear by cutting action over a life of the security destruction machine, and wherein the cut bar pivot limit mechanism adjusts for the cut bar having ablated wear; and other inventive machines.

The invention in another preferred embodiment comprises a security destruction machine comprising cut bar pivot limit screws.

In another preferred embodiment, the invention provides a security destruction machine comprising a shafted cutter and a shaft ending, wherein the shaft ending is polygonal shaped.

Also in another preferred embodiment the invention provides a security destruction machine, wherein output consists entirely of sand-like granules and no oversize chunks.

BRIEF DESCRIPTION OF THE DRAWINGS

FIGS. 11A-11E are cross-sectional views of a gear layout in an embodiment of the invention.

FIGS. 12A-12C are cross-sectional views of a gear array base mount in an embodiment of the invention.

DETAILED DESCRIPTION OF A PREFERRED EMBODIMENT OF THE INVENTION

Advantageously the invention may be used to reduce material to output that consists of sand-like granules, rather than chunks.

Another advantage of the invention is the feature of being able to control particle size by changing the gearbox ratio—by substituting different gears. This feature of merely substituting different gears to control particle size is substantially advantageous compared to a conventional disintegrator that is stuck with the screen as the only control over outputted particle size. In this way, an inventive machine is very different from a conventional disintegrator, because a conventional disintegrator works by a RANDOM CUTTING of material simply dumped into its inlet chute. With the CONTROLLED FEED of an inventive machine, the load is deliberately fed in such that the gearing ratio optimizes cooperation between cutting tooth pitch (space between cutting teeth) and linear feed rate. This means that, in an inventive machine, almost all of a disk is reduced to high-security particle size by the feed-speed combination (and thus can pass through the security screen immediately), and only the last bit of an optical disk need be randomly chopped until it falls through the screen.

Thus cutting to a fine particle size is very time-efficient in the invention. By contrast, cutting to a fine particle size would not be practical using a conventional disintegrator with a very fine screen; the random cutting operation would take way too much time.

A further advantage of the invention is that particle size of output is smaller than other technologies, whether shredder or disintegrator.

A DESKTOP-sized machine 1 according to FIGS. 1-10D advantageously destroys optical media completely into only residue that is small enough to satisfy current NSA high-security Optical Destruction specifications as detailed above.

Figure 1:
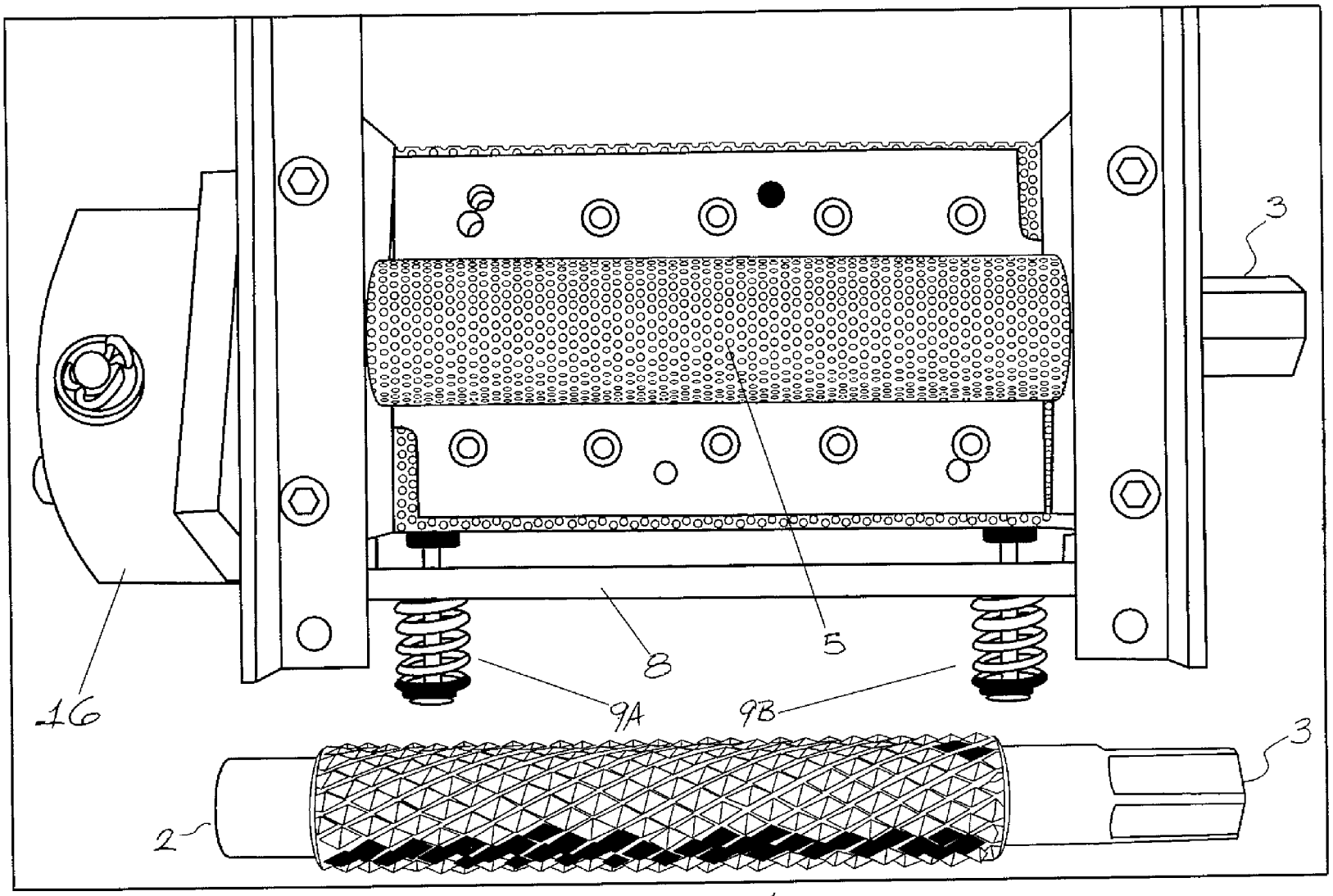
FIG. 1 is a perspective view of an assembly comprising a cutter and screen in an embodiment of the invention.
Figure 2:
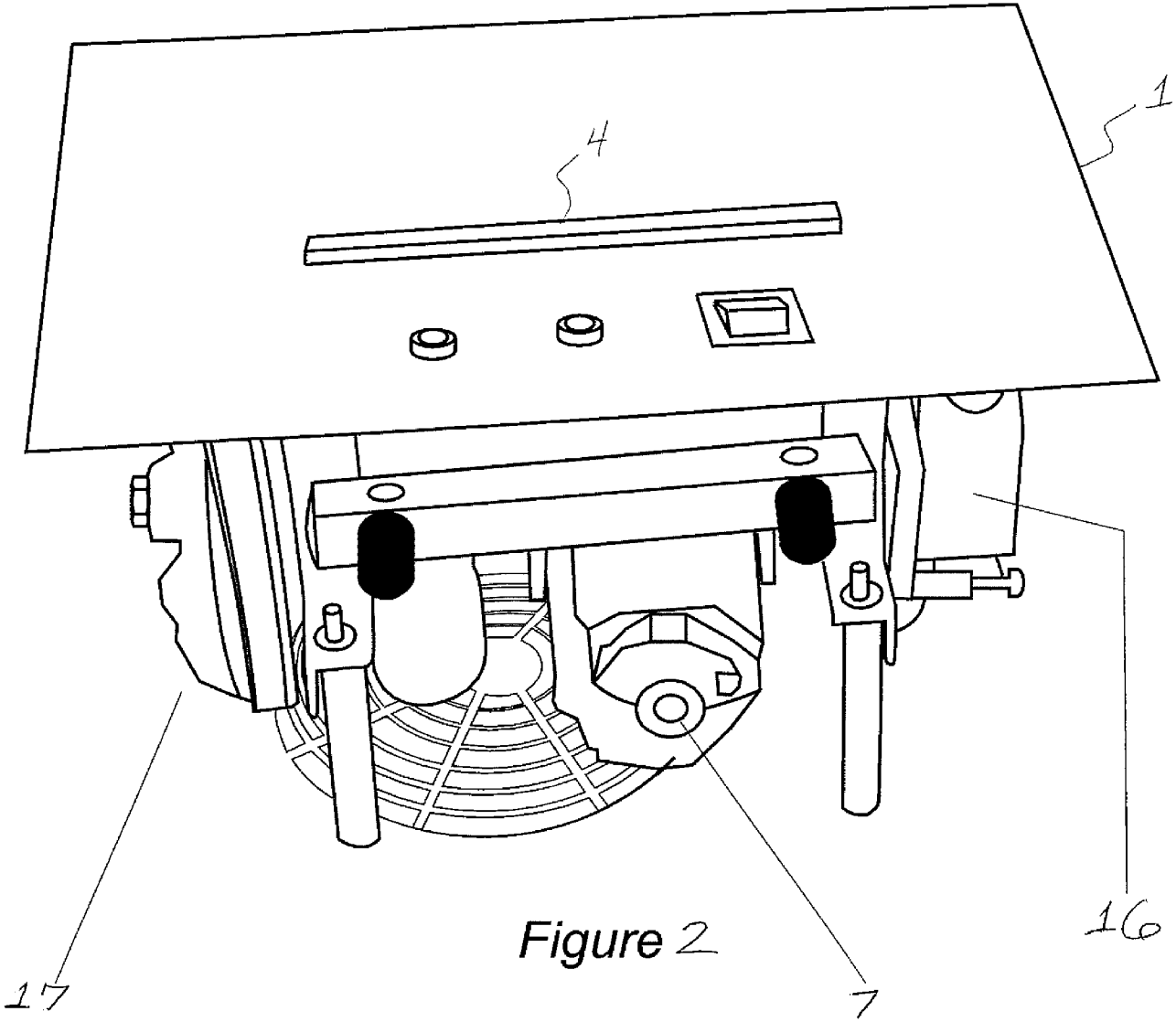
FIG. 2 is a perspective, quasi-exploded view of an inside of a destruction machine 1 in an embodiment of the invention.

Referring to FIG. 1, the inventive machine comprises a patterned cutter 2, preferably a cylindrical cutter, most preferably an inventive cutter that is a 16-tooth burr, with a dual-helical diamond pattern which is a staggered pattern having two spiral angles.

The cutter 2 has a shaft ending 3, which preferably is a polygonal shaft ending. A polygonal shaft ending is suited for mechanically simple, positive, high-force engagement between the driving member (such as a pulley or gear) and the cutter shaft. A smooth cylindrical shaft ending would be undesirable.

Machine 1 (FIG. 2) is particularly suited to destroy a disk D (shown in FIGS. 3 & 4) which is a round-shaped load, due to the machine 1's being able to conform to variability of the load, especially of the round shape of the disk D. Preferably drive Motor 6 (FIG. 5) is specifically intended and selected to be of a type that increases torque when slowed, and increases speed when the load is relieved. Such a motor can power through a heavier load by slowing, but is not limited to this slower, load-handling speed. When the disk D first enters machine 1 via slot 4 in feed guide 20 (FIG. 14), only a small portion of the diameter is presented for cutting; machine 1 thus goes fast. As the middle, biggest diameter portion of disk D is reached, machine 1 slows down due to the increased load. Finally, machine 1 gradually speeds up as the disk D passes the midpoint and the cutting system processes a diminishing portion of the disk D. Machine 1 thus varies its speed according to the load, optimizing throughput.

Figures 13, 14, 15, 16, 17, 17A, 18:
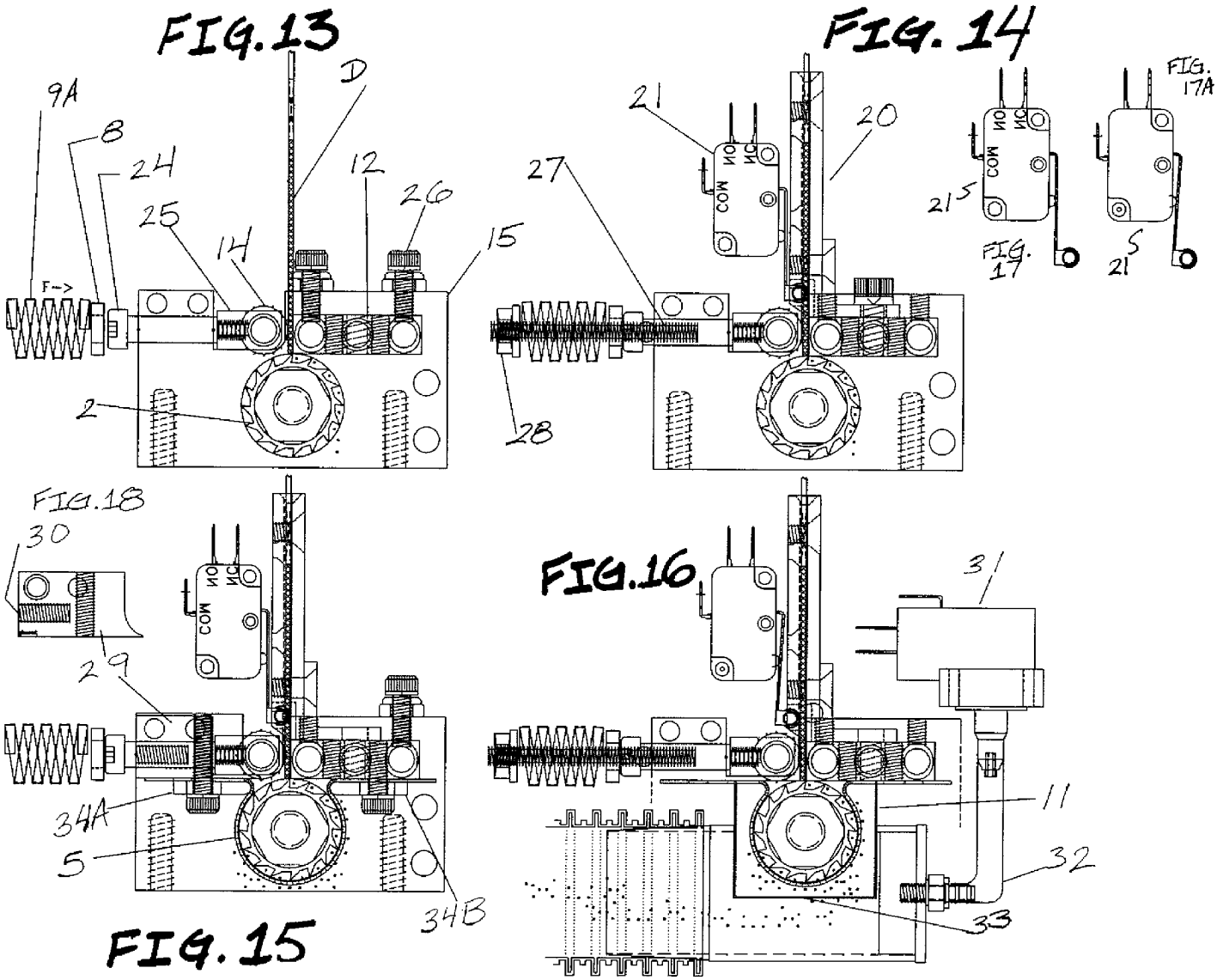
FIGS. 13-16 are cross-sectional views of an assembly including a screened cutter according to an embodiment of the invention.
FIG. 17 is a detail of the disk detect switch of FIG. 14, in relaxed state.
FIG. 17A corresponds to FIG. 17, in actuated state.
FIG. 18 is a detail of FIG. 15's clamp bar 29 with tapped holes for studs.

Machine 1 comprises disk detect switch 21 (FIG. 14) positioned to detect entry of disk D into slot 4, just as the disk D contacts the feed roller 14 (FIG. 13).

A screen 5 (FIG. 15) is tightly wrapped around (but not actually touching) cutter 2, such as wrapped about ¾ (about 280 degrees) of the way around cutter 2. In operation when an optical disk D is being destroyed by machine 1, the end-of-disk piece (the final remaining sliver of disk D material released by the pinch roller) passes around in screen 5, dragged by the cutter teeth, until having been cut small enough to escape through screen 5. Screen 5 should NOT touch cutter 2 during machine operation. An example of clearance between screen 5 and cutter 2 is in a range of about $5/1{,}000$ to $30/1{,}000$ of an inch. If screen 5 is wrapped too close to the cutter 2, the rotating cutter 2 will destroy screen 2. If screen 5 is wrapped too far from rotating cutter 2, chips and slivers of material might lay against screen 5, blocking screen 5 and never be chopped fine enough to exit as intended. Preferably a long tubular shape is used to make screen 5 of thin yet stiff stainless steel.

To hold screen 5 (FIG. 1 & FIG. 15) in position, preferably screen clamps are used, such as to hold screen 5 rigidly in position by a pair of flat metal clamps 34A, 34B (FIG. 15). Examples of clamps 34A, 34B are clamps that are about 5" long×about 1"×⅛" thick. A preferred construction is for holding screws to vertically penetrate the clamps 34A, 34B, then the screen 5 flats, and are threaded into holes in the clamp bar 29 on one side of the screen 5, and the cut bar 12 on the other side of the screen 5.

Screen 5 addresses the "end-of-disk" issue, on which there is almost no data, because of the blank margin at the outer limits of the disc. Therefore screen 5 is unlike a screen in a conventional disintegrator which absolutely REQUIRES a screen, for almost all of its operation, because it has no precision-feed capability.

Pressure bar 8 (FIG. 4) is pushed inward by pressure springs 9A, 9B. Pressure screw 24 is shown in FIG. 13. Stud 27 (FIG. 14) is a mount for pressure springs and allows for inward and outward sliding motion of pressure bar 8, so as to push inward on the heads of pressure screws 24. Pressure adjust nut 28 is shown in FIG. 14.

Machine 1 preferably includes motor 6 (FIG. 5) to drive cutter 2, and vacuum motor 7 (FIG. 6) to drive vacuum unit 10. Preferably motor 6 is used in combination with toothed drive pulley 22.

Figure 5:
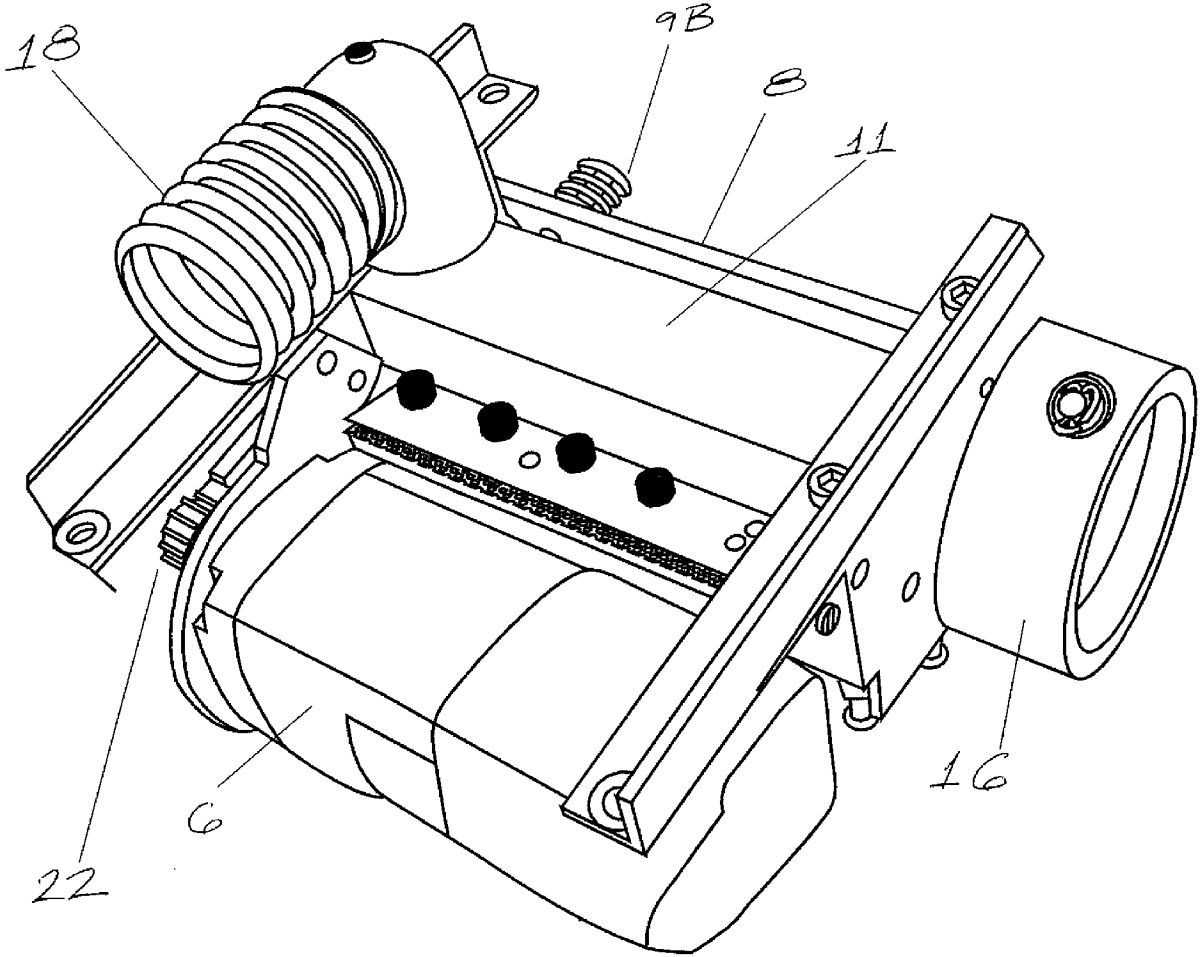
FIG. 5 is a perspective bottom view of an assembly comprising a residue channel in an embodiment of the invention.
Figure 6:
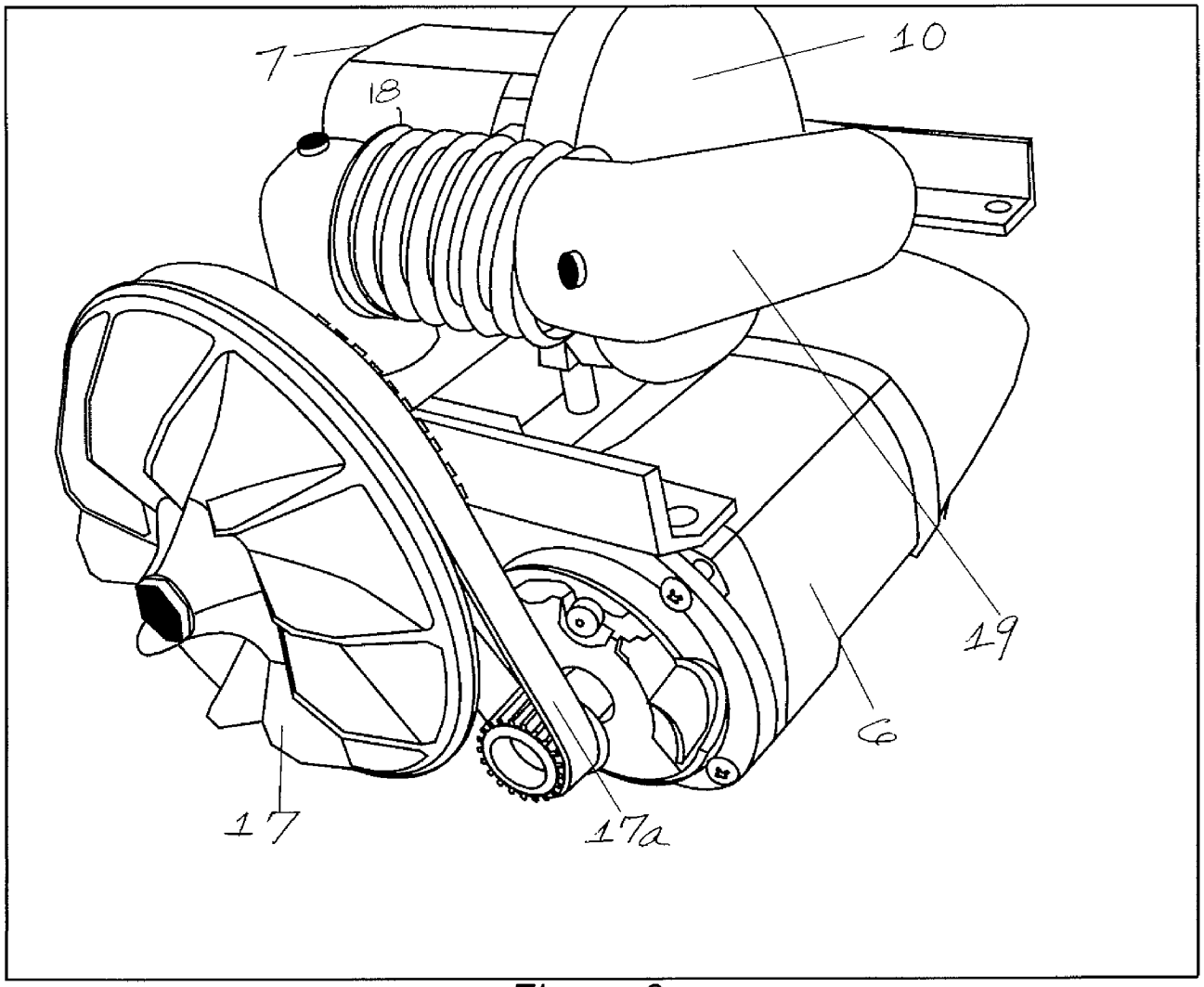
FIG. 6 is a perspective bottom view of an assembly comprising a vacuum system in an embodiment of the invention.

Screen 5 (FIGS. 1 & 15) is surrounded in turn, by a collection channel 11 (FIG. 16), which preferably is U-shaped for economy of manufacture)), which is sealed on its two ends against the surrounding structure (FIG. 5).

Cut bar 12 (FIGS. 3 & 13)) (which preferably is a smooth semi-hardened steel surface) has a surface (preferably a smooth facing surface) against which is pushed the disk D. Preferably cut bar 12 is a pivoting bar which can pivot through a very small angle.

Pivot limit adjusting screw 26 is shown in FIG. 13.

Preferably zero-clearance between cutter 2 and cut bar 12 is maintained in operation, by use of a cut bar pivot limit mechanism. (By "cut bar pivot limit" mechanism or screw, the same is meant as when the inventor previously mentioned a "teeter-totter" mechanism or screw but which is terminology that the inventor no longer uses.) By thus using the smooth face of cut bar 12, advantageously a costly second roller and associated drive mechanism are avoided. In machine 1, a pinch roller 14 (FIG. 13), preferably a knurled pinch roller, most preferably a sharply knurled pinch roller) squeezes disk D against cut bar 12. Cut bar 12's lower edge (the edge at the bottom of the face, nearest the Cutter) resembles the edge of a "bed blade" in a conventional disintegrator. The to-be-destroyed disk D material is chopped by the action of cutter 5's teeth against this edge of cut bar 12.

Figure 3:
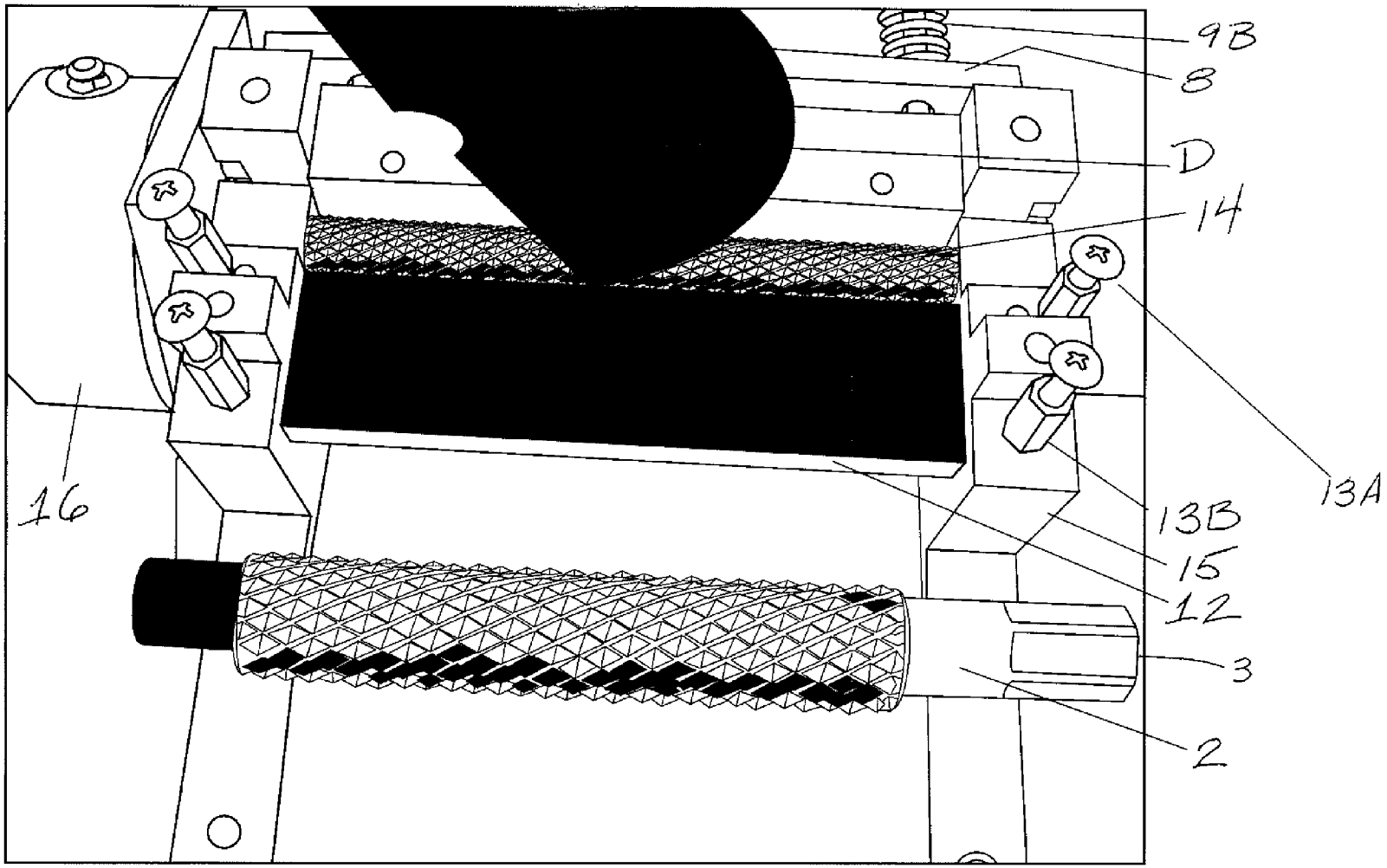
FIG. 3 is a perspective top view of an assembly comprising a roll, cut bar and a cut bar pivot limit in an embodiment of the invention.
Figure 4:
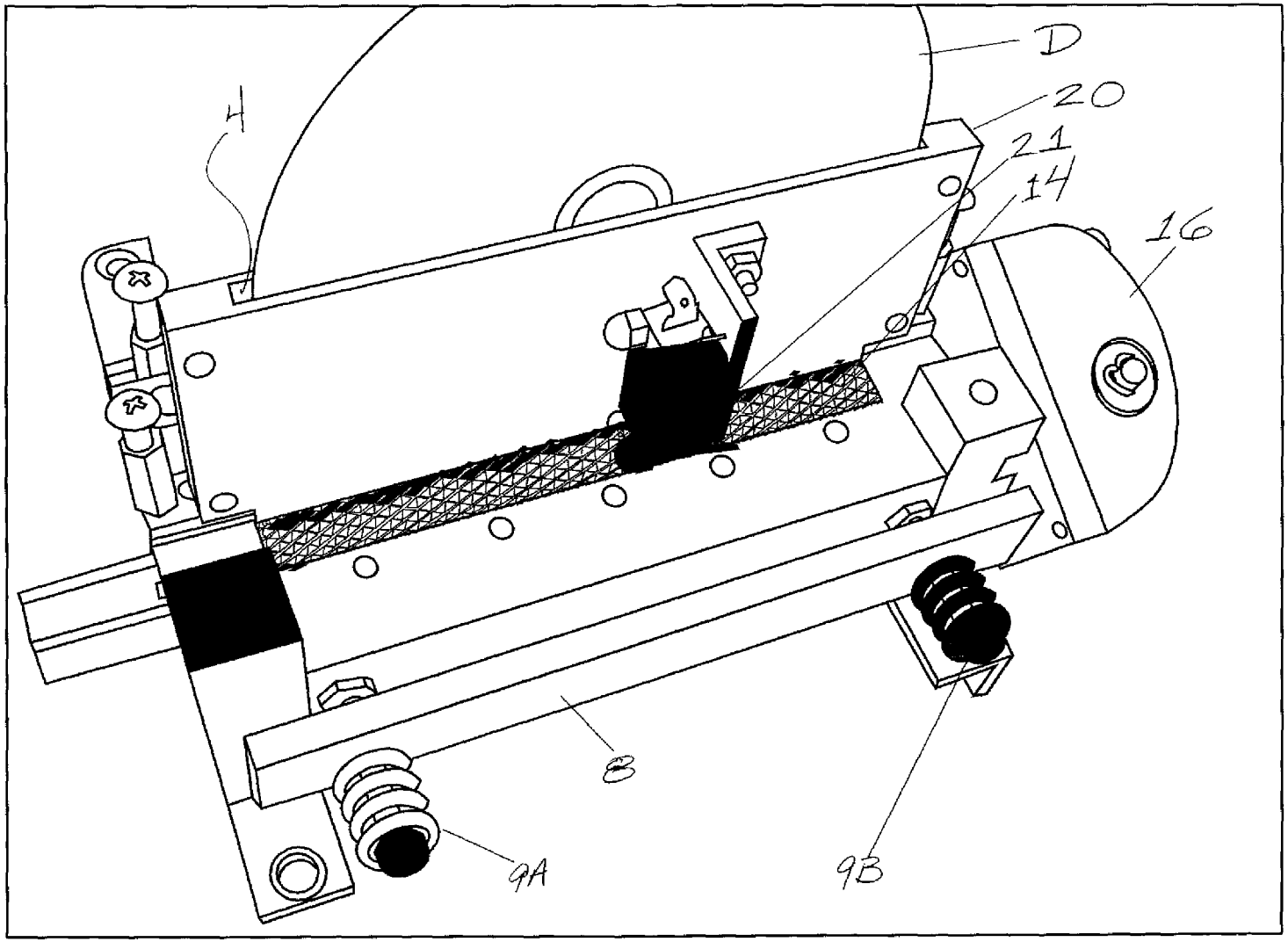
FIG. 4 is a perspective view of an assembly comprising a feed guide and a detector in an embodiment of the invention.

Machine 1 includes a cut bar pivot limit mechanism comprising cut bar pivot limit screws 13A, 13B (FIG. 3) and 26 in FIG. 13 as follows. Tapped holes 30 are included at each end of cut bar 12. Round shoulders (shoulder screws) are mounted to these holes and protrude into oval holes in the side plates. These shoulders can be constructed by turning down the head of a conventional shoulder screw (which is a known kind of screw), so that the shoulder remain entirely within the confines of the side plate 15 (FIGS. 3 and 13).

A cut bar pivot limit mechanism comprising cut bar pivot limit screws 13A, 13B addresses the situation that as machine 1 ages, ablated wear occurs by virtue of the cutting action.

Machine 1 comprises a controlled feed system to achieve consistently small particle size. It will be appreciated that when working with a form factor of desktop size there is only so much horsepower available from a motor that will fit within machine 1. There are limitations to how fast that amount of horsepower can cut disk D into tiny pieces. If feeding of disk D is done too fast, motor 6 will be stalled as a result of cutter 2 taking too big a bite of disk D. Controlled feed prevents that from happening, and provides (via the gearing ratio cooperating with cutter pattern design) control over particle size.

Machine 1 comprises feed roll 14 (FIGS. 3 and 13) which preferably is a custom pinch roller, most preferably a pinch roller that is sharply diamond-knurled, so as to "bite" into the disk and maintain strict control of feed. Feed roll 14 begins to move when activated by rotation of machine 1 starting which is caused when disk D being stuck into machine 1 has tripped a trip switch. Feed roller 14 is intended to grip disk D very firmly, but meanwhile controlled-driving disk D downwards into cutter 2. Meanwhile, cutter 2 must be prevented from self-feeding because of the overload problem if cutter 2 self-feeds. Therefore controlled feed is needed, and is also important for particle size control.

Feed roller 14's shaft is held by ends, such as by use of a floating bushing at each end, and preferably using tight strong springs. Machine 1 comprises exactly one feed roller 14. Avoidance of need for a second pinch roller is considered advantageous as each pinch roller, and its associated drive and pivoting requirements tend to add substantially to cost and complexity of constructing a practical machine.

Referring to FIG. 13, feed roller 14 grabs disk D and squeezes disk D against cut bar 12. Preferably feed roller 14 pushes in, but is constrained so as to never actually touch cut bar 12 when no disk D is present, so as to prevent wear on the sharp edges of the pinch roller knurls by the cut bar. There is a little gap that is the "end of disk" gap, of about 0.225 inch. This is the "gap" between the end of pinch-roller-engagement and cutter 2's edge. When disk D is almost finished, the feed roller 14 releases the small remaining sliver of material into the cutting area in an uncontrolled fashion. Screen 5 ensures that the "end-of-disk" sliver is properly processed to fine residue. The "end of disk" issue is well known in the high-security shredder industry as the "end-of-page" security issue.

The inventive disk drive pinch-roller system serves two functions: a) controlled feed into the cutting section (differently from a conventional disintegrator, which has RANDOM cutting action, allowing possibility of overload when the disintegrator's cutting knives take too big a bite and there is no controlled feed); and b) keeping too much material OUT of the cutting system—because it also PREVENTS self-feeding (differently from a disintegrator which will positively self-feed purely by virtue of its geometry and configuration; the disintegrator operator must attempt to control the feed rate to prevent overload, stalling or jamming); c) controlling particle size ab initio, so that there is little or not "waiting" for random cutting action to get achieve the required particle size to pass through the screen.

Machine 1 comprises side plate 15 (FIGS. 3 & 13). Side plate 15 preferably includes holes for bearings that hold the cutter 2's shanks, the cut bar pivot limit mechanism comprising the cut bar pivot limit screws 13A, 13B, and support notches for feed roller 14's sliding bushings 25 (FIG. 13). Preferably there are attachment points at top and attachment points below side plate 15. Preferably machine 1 includes a pair of side plates 15.

Figure 7:
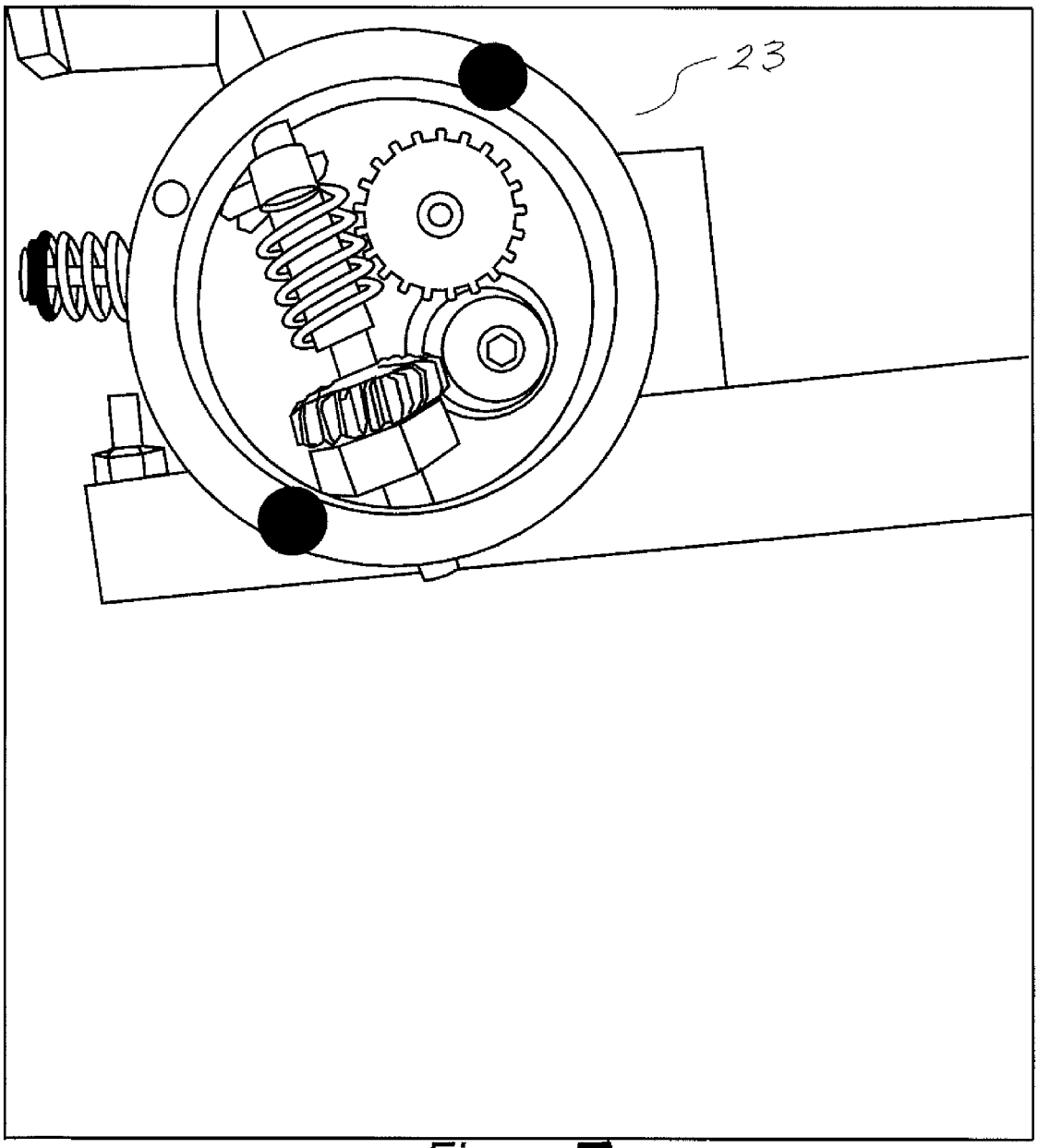
FIG. 7 is a perspective view of an assembly comprising a gear assembly 23 in an embodiment of the invention.

Machine 1 comprises gearbox 16 (FIG. 3) which comprises a gear system such as gear assembly 23 (FIG. 7). A preferred example of a gear system for use in the invention is described in Example 4, and referring to FIGS. 7-10D. A preferred example of a gearbox 16 is a gearbox that allows alignment and precise meshing with a shaft center that translates laterally, and wherein a center-to-center distance between driving and driven shafts need not remain constant.

A "swinging gearbox" of the conventional type used in some lawn mowing equipment, or a gearbox in which center-to-center distance between two shafts must remain constant, are examples considered undesirable for use as gearbox 16.

A cooling fan 17 (FIG. 6) is disposed in machine 1. Cooling fan 17 is secured to the large cutter drive pulley, largely hidden by fan 17 in FIG. 6. The cutter drive pulley operates via drive belt 17*a*.

If residue (i.e., destroyed disk D) is permitted to just fall freely on its own within machine 1, the residue could tend to pile up by feed roller 14 and somewhat within screen 5, which would be unwanted. Therefore, preferably a gentle vacuum device (namely, using a vacuum plenum implemented as a residue channel) 11 (FIG. 5) is included within machine 1 and is provided via vacuum connection 18 (FIG. 5). Vacuum connection 18 is connected to suction line 19 (FIG. 6) to the residue channel. Alternatively, an external vacuum cleaner can be connected to Vacuum connection 18, for greater residue volume capacity or mounting convenience.

Vacuum switch 31, vacuum sense hose 32 and the chute's residue exit hole 33 are shown in FIG. 16.

Machine 1 preferably is constructed to receive and destroy optical disks fed (if desired, fed continuously) by a human user. A preferred cycle time for machine 1 to accomplish destruction of a single disk D is about 6 seconds.

Machine 1 advantageously is ideal for use, for example, by a worker at his desk who wishes to carry out high-security destruction to NSA-04-02-A specifications of a few optical media disks D personally at his own desk, without disk D leaving his own possession.

A preferred example of a production unit machine according to the invention, is, e.g., a production unit machine which has NO internal vac, residue chamber, or bag and is used with an external vacuum cleaner. Another preferred example is a machine that DOES have an internal chamber or bag, and holds its own limited-quantity residue output.

The invention may be further appreciated by reference to examples herein, without the invention being limited thereto.

Example 1

Early Prototype Machine

An inventive prototype deskside machine that was constructed had an empty weight of about 16.3 pounds, and a form factor of about 11½ inches by 9 inches, by 12¾ inches in height (exclusive of the protruding nozzle and bin cap).

This inventive machine was constructed as follows.

Cutter.

An inventive cylindrical cutter was constructed which is similar to a high-speed burr. "Burr" is also known as a patterned cutter. The cutter was a 16-tooth burr, with a dual-helical diamond pattern. This was a custom-made part. The actual cutting length is about 5 inches so as to fully encompass the 4.8" diameter of Optical Media disks.

The cutter was designed for "controlled length" cutting and a "reamer" blade configuration was not used because a reamer would chop off strips that will be too long, thus exceeding high-security particle-size standards.

A staggered pattern was used on the cutter, which was a diamond cutter and had two spiral angles.

Polygonal Cutter Shaft Ending.

The cutter had a cutter shaft with a customized shaft ending, namely, a polygonal shaft ending for positive high-force engagement between the driving member (such as a pulley or gear) and the cutter shaft. A smooth circular shaft ending was thus avoided.

Main Motor.

The motor for the cutter was the main motor. This main motor also was used to drive the blower and the gear system, which drives the pinch roller. A universal motor, also known as an AC/DC motor, was used as the main motor.

The "universal", AC-DC main motor type was selected to provide relatively high horsepower in a small lightweight package; the main motor puts out about ¾ peak hp.

As the main motor is slowed by loading during cutting, the motor puts out more torque. In this inventive machine, when the cutter slows, so does the feed. A purely mechanical linkage between cutter slowing and feed slowing is provided. This linkage makes the machine go as fast as it can go to get through the load in the shortest possible time.

The machine has a feature of variability, namely the machine conforms to variability of the load, especially of the round shape of the disk. When the disk first enters, only a small portion of the diameter is presented for cutting. The machine thus goes fast. As the middle, biggest diameter portion is reached, the machine slows down due to the increased load. Finally, the machine gradually speeds up as the disk passes the midpoint and the cutting system processes a diminishing quantity of disk material. The machine thus varies its speed according to the load.

Screen.

A screen was wrapped about ¾ of the way around the Cutter. In operation when an optical disk is being chopped up by the machine, the end-of-disk piece (the final remaining sliver of disk material released by the pinch roller) rattles around in the screen until having been cut small enough to escape through the screen. The screen did NOT touch the patterned cylindrical cutter during machine operation. About 15/1,000 of an inch was the clearance between the screen and the burr in the prototype machine. An example of a preferred range for clearance between a screen and cutter is 5/1,000 to 30/1,000 of an inch. If the screen is wrapped too close to the burr, the rotating burr will destroy the screen. If the screen is wrapped too far from the rotating Cutter, it is possible for chips and slivers of material to lay against the screen, blocking it and never being chopped fine enough to exit as intended. A long tubular shape was used to make the screen of thin yet stiff stainless steel.

The screen was wrapped about 280 degrees around the burr.

Screen Clamps.

The screen was rigidly held in position by a pair of flat metal clamps.

Vacuum Motor.

A second motor was used, which drives a very compact vacuum unit.

Screen Residue Collection Channel.

The screen was surrounded in turn, by a U-shaped Residue Collection Channel, which is sealed against the surrounding structure. It was connected via plumbing to the Vacuum inlet, which helped draw chopped residue through the Screen, and then pumped the residue down through the Deck.

Cut Bar.

The cut bar was a smooth semi-hardened steel surface. The smooth facing surface of the cut bar is what the pinch roller pushed the disk against. The cut bar was a pivoting bar which can pivot through a very small angle. In this prototype machine, zero-clearance between the cutter and a cut bar was maintained in operation, by use of a cut bar pivot limit mechanism. (By "cut bar pivot limit" mechanism or screw, the same is meant as when the inventor previously mentioned a "teeter-totter" mechanism or screw but which is terminology that the inventor no longer uses.) The use of the smooth face of the cut bar advantageously avoided the need for a costly second roller. The machine was configured with the pinch roller squeezing the disk against the cut bar. The lower edge of the Cut Bar (the edge at the bottom of the face, nearest the Cutter) was similar to the edge of a "bed blade" in a conventional disintegrator. The to-be-destroyed disk material was chopped by the action of the Cutter teeth against this edge of the Cut Bar.

Cut Bar Pivot Limit Mechanism.

A cut bar pivot limit mechanism was included as follows. Three tapped holes were included at the each end of the cut bar. Round shoulders (shoulder screws) stuck out of these three holes. These shoulders were constructed by turning down the head of a shoulder screw (which is a known kind of screw). The middle shoulder screw on each end of the Cut Bar was a pivot point.

Two oval holes were provided in each side plate.

A single pivot hole was also provided in each side plate.

I call the screws that were custom designed for this machine "cut bar pivot limit screws". Clamping screws were used to set an exact angle of the cut bar by bearing against the two outer shoulders on each end of the Cut Bar. The clamping screws were useable to set the angle of the Cut Bar so as to obtain zero clearance or to near zero clearance between Cutter and Cut Bar. For this particular machine because the intention was to cut something other than paper, a "true" zero clearance setting was not required, but can be attained if desired by the user. This might occur if the machine is used to process something other than Optical Media.

The cut bar pivot limit mechanism addresses the situation that as the machine ages, ablated wear occurs by virtue of the cutting action.

Enclosure.

As an enclosure, a fireproof molded fiberglass waste basket (Rubbermaid® Commercial) was used. The bottom-most portion of the Rubbermaid® waste basket was used as the bin that accumulates high-security residue; an upper part of the Rubbermaid® waste basket was used to enclose the cutter and other mechanical components.

Deck.

A deck or tray was fitted into the enclosure, parallel with the floor of the enclosure. The deck was located as high up as possible in the enclosure so as to make maximum possible room for residue in the restricted space available in the bin.

Deck Filter.

A large Deck Filter was fitted, which allowed pressurized air (but not residue) from the residue chamber to exit upwards into the machinery area, and thence be carried overboard by the Blower and vents. This was necessary, because the Vacuum pumped air along with residue down through the sealed Deck and into the Residue Chamber. That air required a means of egress. Otherwise, back-pressure would build up in the Residue Chamber, preventing further residue pumping.

In this machine, by design the residue was pumped by the vacuum system downwards, through the sealed deck to the residue chamber below the deck.

A permanent filter, through which air passes, was included, to accomplish air-cooling of the mechanical parts that heat up in operation. The permanent filer was custom-constructed by purchasing a 6-inch fan filter frame and cutting circle of fabric to fit thereon. The permanent filter was positively anchored in the machine.

Sealing.

The deck or tray had sealing around its perimeter so that the sealed perimeter of the deck had a soft and snug fit to the inside of the enclosure (the Rubbermaid® waste basket).

Driven Pulley; Ventilation Impeller.

Air from outside the enclosure was drawn in, and blows around inside, and exits the enclosure, to cool the machinery inside the enclosure. Air was also drawn in from above.

Inlet Slot.

An inlet slot for optical media disks was provided in a top section, the top section being added and not being part of the Rubbermaid® waste basket.

Controlled Feed System.

A controlled feed system was constructed into the prototype in order to achieve consistently small particle size. It will be appreciated that when working with a form factor of the size described there is only so much horsepower available from a motor that will fit within the form factor. There are limitations to how fast that amount of horsepower can cut a disk into tiny pieces. If feeding of the disk is done too fast, the motor will be stalled via a problem of the cutter taking too big a bite of the disk. The controlled feed prevents that from happening, and provides (via the gearing ratio) control over particle size.

Trip Switch.

A trip switch was constructed into the prototype machine, and when the disk goes into the machine, the disk trips the trip switch. The human operator gives the disk a very gentle push to start the disk feeding into engagement with the pinch roller. The trip switch is a sensing switch located near the middle relative to the intake slot, but far enough to one side to avoid tripping ON or OFF by the hole in the center of the all Optical Media Disks.

Push Button.

Because the sensing switch was near the middle, it might not be activated by a too-small or broken piece. Therefore a push button also was included for a manual start, to force turn-on. This was used for broken or small pieces.

Pinch Roller.

A custom pinch roller was constructed. The pinch roller was coarsely diamond-knurled. The diamond-knurled pinch roller began to rotate when activated by rotation of the machine starting which is caused when a disk being stuck into the machine tripped the trip switch. The pinch roller was intended to grip the disk very firmly, but at the same allowing time to pass the disk through. Meanwhile, the cutter must be prevented from self-feeding because of the overload problem if the cutter self-feeds. Therefore controlled feed was needed, and was also important for particle size control.

The roller shaft was held by its end shanks. Tight strong springs were used. A floating bushing at each end held the pinch roller ends.

The pinch roller was a moving pinch roller, namely, the whole roller moved back. The design was to keep driving the pinch roller while the pinch roller was moving. To do so, a positive drive was used that stayed engaged while the roller moved in and out, while also conforming to the disk thickness.

In this machine, exactly one pinch roller was used. Avoidance of need for a second pinch roller was considered advantageous as each pinch roller, and its associated drive and pivoting requirements tend to add substantially to machine cost and complexity.

The pinch roller grabbed the disk and squeezed it against the cut bar. The pinch roller pushed in but was constrained so as to never actually touch the cut bar when no disk was present. There was a little gap that was the "end of disk" gap, of about 0.225 inch. This was the "gap" between the end of pinch-roller-engagement and the cutter edge. When the disk was almost finished, the pinch roller released the small remaining sliver of material into the cutting area in an uncontrolled fashion. This face necessitated the use of a screen to make sure that the "end-of-disk" sliver was properly processed to fine residue. The "end of disk" issue is well known in the high-security shredder industry as the "end-of-page" security issue.

The inventive disk drive pinch-roller system serves two functions: a) controlled feed into the cutting section (differently from a conventional disintegrator, which has RANDOM cutting action, allowing possibility of overload when the disintegrator's cutting knives take too big a bit and there is no controlled feed); and b) keeping too much material OUT of the cutting system—because it also PREVENTS self-feeding (differently from a disintegrator which will positively self-feed purely by virtue of its geometry and configuration; the disintegrator operator must control the feed rate to prevent overload, stalling or jamming); c) controlling particle size ab initio, so that there is little or not "waiting" for random cutting action to get achieve the required particle size to pass through the screen.

Side Plates.

The side plates included holes for the bearings that held the cutter shanks, the cut bar pivot limit mechanism, and support notches for the Pinch Roller sliding bushings 25 (FIG. 13).

There were attachment points at top and attachment points below the Side Plates.

Gear Set.

The machine included a double reduction worm gear set. First, a 10:1 reduction was provided by one worm gear set, which was cascaded to another worm gear set, which amounted to a 100:1 overall reduction between Cutter and Pinch Roller.

A total of four gears were included, driven off the main Cutter shaft. The gears stayed in mesh, due to a special pivoting mechanism, as the Pinch Roller shaft moved to and fro in conformance to disk thickness. Positive control was provided, always relative to the speed of the cutter.

A first gear stayed in mesh with a final gear and in mesh with other gears even though the axle of the pinch roller was translating laterally.

This gear assembly had no appreciable backlash as is typical of worm gear sets.

The disk came through the pinch-roller/Cut Bar assembly. A tooth of the cutter whacked the disk by a certain length (this occurred for about 98% of the disk), which was a "controlled length" operation. I refer to this as the primary means of controlling particle size in this machine.

Vacuum Device.

During design development, it was found that if the residue was permitted to just fall freely on its own, the residue tended to pile up by the pinch roller and somewhat within the screen, which was not wanted. Therefore, a gentle vacuum device was added, namely, including a vacuum plenum surrounding the screen.

Readiness (Using "Bin Full") Indicator.

A red light indicator was provided and lights to indicate a short period while waiting for sufficient vacuum for the machine to function.

Bin Capacity.

The bin that accumulated the high-security residue held about 5 pounds of residue (about 70-90 disks).

Bin-Fullness Sensing.

This prototype machine accomplished sensing that the bin was full of residue as follows. The sensing principle was to sense vacuum. As the bin filled with residue, this caused a back pressure as exiting air was blocked. When a certain back pressure was sensed, vacuum available was decreased, sensed, and the Cutter Motor was shut down, so that the user could not feed a disk into the intake slot anymore. This system also provided a safety function, in that if sufficient vacuum was unavailable FOR ANY REASON, the Cutter Motor (and thus also the feed drive system) were shut down.

Bin-Full Indicator.

A red light was provided that showed that the bin was full, or that vacuum was insufficient for operation.

Bin Cap.

A hole was made in the bin (which is a hole in the enclosure), fitted with an exit nozzle, and a bin cap was provided thereon. The exit nozzle was intended to be capped during operation of the machine, and the bin cap was removable by unscrewing in order to empty the bin of residue. One way to empty the bin was to uncap the bin cap and manually empty the bin by pouring the residue out directly into a plastic disposal bag. Another way to empty the bin was to uncap the bin and shake the residue into a garbage pail or collection pail. Another way to empty the bin was to uncap the bin, and screw on a vacuum cleaner attachment and vacuum out the residue. Also, a plastic or filter bag can be threaded onto the uncapped exit nozzle.

Strap Handle.

A strap handle was built onto this inventive prototype machine. The strap handle was considered preferable for cost reasons to a possible folding handle.

Top Plate.

The top plate, also called the panel plate, was a custom-constructed part and not part of the Rubbermaid® waste basket. The machine hung from the top plate. The top plate was securely fastened to the top of the bin, and firmly held the machine in proper location within the bin.

Power.

The electrical system used in the prototype was for standard USA domestic 115V. There was also a 220V version design for European use.

The inventive prototype machine thus constructed was tested and accepted optical disks fed by a human user; the disks can be fed continuously by the user. The cycle time was about 6 seconds.

This prototype machine is ideal for use, for example, by a worker at his desk who wishes to carry out high-security destruction of a few optical media disks personally at his desk.

EXAMPLE 1A

Constructed Machine

An inventive prototype deskside machine that has been constructed has an empty weight of about 16.3 pounds, and a form factor of about 11.5 inches by 9.4 inches, by 7.8 inches in height.

This inventive machine has been constructed as follows.

Cutter.

An inventive cylindrical cutter was constructed which is similar to a high-speed burr. "Burr" is also known as a patterned cutter. The cutter is a 16-tooth burr, with a dual-helical diamond pattern. This is a custom-made part. The actual cutting length is about 5 inches so as to fully encompass the 4.8" diameter of Optical Media disks.

The cutter is designed for "controlled length" cutting and a "reamer" blade configuration is not used because a reamer would chop off strips that will be too long, thus exceeding high-security particle-size standards.

A staggered pattern is used on the cutter, which is diamond cutter and has two spiral angles.

Polygonal Cutter Shaft Ending.

The cutter has a cutter shaft with a customized shaft ending, namely, a polygonal shaft ending for positive high-force engagement between the driving member (such as a pulley or gear) and the cutter shaft. A smooth cylindrical shaft ending was thus avoided.

Main Motor.

The motor for the cutter is the main motor. This main motor also is used to drive the blower and the gear system, which drives the pinch roller. A universal motor, also known as an AC/DC motor, was used as the main motor.

The "universal", AC-DC main motor type was selected to provide relatively high horsepower in a small lightweight package; the main motor puts out about ¾ peak hp.

As the main motor is slowed by loading during cutting, the motor puts out more torque. In this inventive machine, when the cutter slows, so does the feed. A purely mechanical linkage between cutter slowing and feed slowing is provided. This linkage makes the machine go as fast as it can go to get through the load in the shortest possible time.

The machine has a feature of variability, namely the machine conforms to variability of the load, especially of the round shape of the disk. When the disk first enters, only a small portion of the diameter is presented for cutting. The machine thus goes fast. As the middle, biggest diameter portion is reached, the machine slows down due to the increased load. Finally, the machine gradually speeds up as the disk passes the midpoint and the cutting system processes a diminishing portion of the disk. The machine thus varies its speed according to the load, and processes the load as quickly as its own basic horsepower permits.

Screen.

A screen was wrapped about ¾ of the way around the Cutter. In operation when an optical disk is being chopped up by the machine, the end-of-disk piece (the final remaining sliver of disk material released by the pinch roller)) passes around in screen 5 (FIG. 15), dragged by the cutter teeth, until having been cut small enough to escape through the screen. The screen should NOT touch the patterned cylindrical cutter during machine operation. About $^{15}/_{1,000}$ of an inch is the clearance between the screen and the burr in the prototype machine. An example of a preferred range for clearance between a screen and cutter is $^{5}/_{1,000}$ to $^{30}/_{1,000}$ of an inch. If the screen is wrapped too close to the burr, the rotating burr will destroy the screen. If the screen is wrapped too far from the rotating Cutter, it is possible for chips and slivers of material to lay against the screen, blocking it and never be chopped fine enough to exit as intended. A long tubular shape is used to make the screen of thin yet stiff stainless steel.

The screen is wrapped about 280 degrees around the burr.

Screen Clamps.

The screen is rigidly held in position by a pair of flat metal clamps.

Vacuum Motor.

A second motor is used, which drives a very compact vacuum unit. Alternatively, an external vacuum cleaner can be connected to Vacuum connection 18 (FIG. 5), for greater residue volume capacity or mounting convenience.

Screen Residue Collection Channel.

The screen is surrounded in turn, by a U-shaped Residue Collection Channel 11 (FIG. 5), which is sealed against the surrounding structure. It is connected via plumbing to the Vacuum inlet, which helps draw chopped residue through the Screen.

Cut Bar.

The cut bar 12 (FIGS. 3 & 13) is a smooth semi-hardened steel surface. The smooth facing surface of the cut bar is what the pinch roller pushes the disk against. The cut bar is a pivoting bar which can pivot through a very small angle. In this machine, zero-clearance between the cutter and a cut bar is maintained in operation, by use of a cut bar pivot limit mechanism. (By "cut bar pivot limit" mechanism or screw, the same is meant as when the inventor previously mentioned a "teeter-totter" mechanism or screw but which is terminology that the inventor no longer uses.) The use of the smooth face of the cut bar (in cooperation with the aggressive tooth design and high pressure of the knurled roller) advantageously avoids the need for a costly second roller. The machine is configured with the pinch roller squeezing the disk against the cut bar. The lower edge of the Cut Bar (the edge at the bottom of the face, nearest the Cutter) is similar to the edge of a "bed blade" in a conventional disintegrator. The to-be-destroyed disk material is chopped by the action of the Cutter teeth against this edge of the Cut Bar.

Cut Bar Pivot Limit Mechanism.

A cut bar pivot limit mechanism is included as follows. Three tapped holes are included at the each end of the cut bar. Round shoulders (shoulder screws) are mounted to these holes and protrude into oval holes (visible in FIG. 13, just below Pivot Screw 26) in the side plates. These shoulders can be constructed by turning down the head of a shoulder screw (which is a known kind of screw), so that the shoulder remains entirely within the confines of the side plate 15.

The middle shoulder screw on each end of the Cut Bar is a pivot point.

Two oval holes are provided in each side plate.

A single pivot hole is also provided in each side plate.

I call the screws that were custom designed for this machine "cut bar pivot limit screws". Clamping screws 26 (FIG. 13) are used to set an exact angle of the cut bar by bearing against the two outer shoulders on each end of the Cut Bar. The clamping screws are useable to set the angle of the Cut Bar so as to obtain zero clearance or to near zero clearance between Cutter and Cut Bar. For this particular machine because the intention was to cut something other than paper, a "true" zero clearance setting is not required, but can be attained if desired by the user. This might occur if the machine is used to process something other than Optical Media.

The cut bar pivot limit mechanism addresses the situation that as the machine ages, ablated wear occurs by virtue of the cutting action.

Alternatively, the action of maintaining zero or near-zero clearance can be motorized and thus automated.

Enclosure.

A commercially available standard high-quality non-metallic electrical equipment enclosure is used.

Driven Pulley; Ventilation Impeller.

Air from outside the enclosure is drawn in, and blows around inside, and exits the enclosure, to cool the machinery inside the enclosure.

Inlet Slot.

An inlet slot for optical media disks is provided in a top section.

Controlled Feed System.

A controlled feed system was constructed into the prototype in order to achieve consistently small particle size. It will be appreciated that when working with a form factor of the size described there is only so much horsepower available from a motor that will fit within the form factor. There are limitations to how fast that amount of horsepower can cut a disk into very tiny pieces. If feeding of the disk is done too fast, the motor will be stalled via a problem of the cutter taking too big a bite of the disk. The controlled feed prevents that from happening, and provides (via the gearing ratio to the feed roll) control over particle size.

Trip Switch.

A trip switch was constructed into the prototype machine, and when the disk goes into the machine, the disk trips the trip switch. The human operator gives the disk a very gentle push to start the disk feeding into engagement with the pinch roller. The trip switch is a sensing switch located near the middle relative to the intake slot, but far enough to one side to avoid tripping ON or OFF by the hole in the center of the all Optical Media Disks. The switch also turns the machine off when the disk has passed through. For this reason, the switch's operating roller is placed very near the cutter and feed roller.

Push Button.

Because the sensing switch is near the middle, it might not be activated by a too-small or broken piece. Therefore a push button also was included for a manual start, to force turn-on. This is used for broken or small pieces, or for loads other than optical disks, such as "smart cards" or credit cards.

Pinch Roller.

A custom pinch roller was constructed. The pinch roller is sharply diamond-knurled, so as to "bite" into the disk and maintain strict control of feed. The diamond-knurled pinch roller begins to move when activated by rotation of the machine starting which is caused when a disk being stuck into the machine has tripped the trip switch. The pinch roller is intended to grip the disk very firmly, but also allowing the disk to pass through. Meanwhile, the cutter must be prevented from self-feeding because of the overload problem if the cutter self-feeds. Therefore controlled feed is needed, and is also important for particle size control.

The roller is held by its end shanks. A floating bushing at each end holds the pinch roller end shanks. Tight strong springs are used.

The pinch roller is moving pinch roller, namely, the whole roller moves back and forth, remaining parallel to the cutter axis. The design is to continuously drive the pinch roller while the pinch roller is moving laterally. To do so, a positive drive is used that always stays engaged while the roller moves in and out, while also conforming to the disk thickness.

In this machine, exactly one pinch roller is used. Avoidance of need for a second pinch roller is considered advantageous as each pinch roller, and its associated drive and pivoting requirements tend to add substantially to machine cost and complexity.

The pinch roller grabs the disk and squeezes it against the cut bar while driving the disk downwards into the cutter. The pinch roller pushes inwards but is constrained so as to never actually touch the cut bar when no disk is present to prevent wear on the sharp edges of the pinch roller knurls by the cut bar. There is a little gap that is the "end of disk" gap, of about 0.225 inch. This is the "gap" between the end of pinch-roller-engagement and the cutter edge. When the disk is almost done, the pinch roller releases the small remaining sliver of material into the cutting area in an uncontrolled fashion. This necessitates the use of a screen to make sure that the "end-of-disk" sliver is properly processed to fine residue. The "end of disk" issue is well known in the high-security shredder industry as the "end-of-page" security issue.

The inventive disk drive pinch-roller system serves two functions: a) controlled feed into the cutting section (differently from a conventional disintegrator, which has RANDOM cutting action, allowing possibility of overload when the disintegrator's cutting knives take too big a bit and there is no controlled feed); and b) keeping too much material OUT of the cutting system—because it also PREVENTS self-feeding (differently from a disintegrator which will positively self-feed purely by virtue of its geometry and configuration; the disintegrator operator must control the feed rate to prevent overload, stalling or jamming); c) controlling particle size ab initio, so that there is little or not "waiting" for random cutting action to get achieve the required particle size to pass through the screen.

Side Plates.

The side plates include holes for the bearings that holds the cutter shanks, the cut bar pivot limit mechanism, and support notches for the Pinch Roller sliding bushings 25.

Gear Set.

The machine includes a double reduction worm gear set. First, a 10:1 reduction is provided by one worm gear set, which is cascaded to another worm gear set, which amounts to a 100:1 overall reduction between Cutter and Pinch Roller.

A total of four gears are included, driven off the main Cutter shaft. The gears stay in mesh, due to a special pivoting mechanism, as the Pinch Roller shaft moves to and fro in conformance to disk thickness and disk presence. Positive control of roll speed is provided, always relative to the speed of the cutter.

A first driving gear always stays in mesh with its driven gear and in cascading mesh with all of the other gears even though the axle of the pinch roller is translating laterally.

This gear assembly has no appreciable backlash as is typical of worm gear sets.

The disk comes through the pinch-roller/Cut Bar assembly. A tooth of the cutter whacks the disk by a certain length (this occurs for about 98% of the disk), which is a "controlled particle length" operation. I refer to this as controlling particle size. The "control" is the result of fixed speed ratios combined with diameters and number of cutter teeth per revolution of the cutter.

Vacuum Device.

During design development, it was found that if the residue was permitted to just fall freely on its own, the residue tended to pile up by the pinch roller and somewhat within the screen, which was not wanted. Therefore, a gentle vacuum device and associated vacuum plenum surrounding the screen and connections were included.

Readiness ("Bag Full/Low Vacuum") Indicator.

A red light indicator is provided and lights to indicate a short period while waiting for sufficient vacuum for the machine to function, of if vacuum is insufficient for any reason.

Bin-Fullness Sensing.

The prototype machine accomplishes sensing that the bin or bag or external vacuum is full of residue as follows. The sensing principle here is to sense vacuum. As the bin or bag or external vacuum fills with residue, this causes a back pressure, as exiting air is blocked. When a certain back pressure is sensed, vacuum available is decreased, sensed, and the Cutter Motor is shut down, so that the user cannot feed a disk into the intake slot anymore. This system also provides a safety function, in that if sufficient vacuum is unavailable FOR ANY REASON, the Cutter Motor is shut down.

Bin-Full Indicator.

A red light is provided that shows that the bin is full, or that vacuum is insufficient for operation. Machine will not run if this indicator is lit.

Power.

The electrical system used in the prototype is for standard USA domestic 115V. There is also a 220V version designed for European use.

The inventive machine of this example thus constructed has been tested and accepts optical disks fed by a human user; the disks can be fed continuously by the user. The cycle time is about 6 seconds.

The machine of this example is ideal for use, for example, by a worker at his desk who wishes to carry out high-security destruction of a few optical media disks personally at his desk.

EXAMPLE 1B

Operation of the early prototype machine of Example 1 and of the constructed machine of Example 1A was carried out as follows with the inventor operating the machine. The operator stuck an optical disk into the intake slot.

The disk being so stuck into the intake slot caused the trip switch to be tripped, which caused the machine to start.

A series of optical disks were thus fed one by one into the machine. The residue was fine dust and only such dust which, from the inventor's experience having previously worked with all relevant NSA specifications for high-security destruction, the characterized as well-exceeding existing specifications for high-security residue.

EXAMPLE 1C

The machine of Example 1B well exceeds minimum NSA requirements when operated to destroy high density optical media. Careful laboratory tests were made and recorded, and screening, using certified screens, of the actual residue output of this machine demonstrate the following residue characteristics (% by mass):

NSA SIZE SPEC. MAXIMA: 90% @ 5 mm, Remainder, 10% @7.0 mm

Test Results #1:

1a) 99.695% LESS THAN 1 mm 1b) 0.304% Between 1.0 and 1.4 mm 1c) 0.001% Between 1.4 and 2.0 mm 1d) No particles exceed 2.0 mm in any dimension Conclusion 1:

This machine exceeds the most stringent (5 mm) current NSA LINEAR SIZE requirements by a factor of AT LEAST 5 for 99.695% of output, and exceeds the "remainder" requirement by a factor of about 3.5. (I say "AT LEAST" a factor of 5 for 99.695% of output because we did not further screen below 1 mm. It was the "target" specification.)

NSA AREA SPEC. MAXIMA: 90% @ 25 sq mm, Remainder, 10% @ 35 sq mm

Test Results #2:

2a) 99.695% LESS THAN 0.785 square mm area 2b) 0.304% Between 0.785 AND 1.541 square mm area 2c) 0.001% Between 1.54 and 3.14 square mm area 2d) No particles exceed 3.14 square mm area.

Conclusion 2:

This machine exceeds the most stringent current NSA area requirements by a factor of AT LEAST 32:1 for 99.695% of output, and exceeds the "remainder" requirement by a factor of about 22:1. (I say "AT LEAST" a factor of 32 for 99.695% of output because we did not further screen below 0.785 square mm area. It was the "target" specification.)

NSA UNSEPARATED PARTICLES SPEC. MAXIMA: 2% BY MASS, AND

The number of connected particles may not exceed 5 (in any connected group)

Test Results #3:

3) There were NO unseparated particles.

Conclusion 3:

This machine exceeds ALL current NSA unseparated particles requirements by an incalculable factor.

The experimentation therefore shows that the tested machine greatly exceeds current NSA standards. The inventor believes that data density on optical media will only increase, and that this will drive a requirement for finer particle sizes. Further the inventor believes that some already-available optical media must be destroyed to finer particle sizes than are currently required to ensure absolute assurance of the destruction of the data contained therein.

EXAMPLE 1D

Regarding Even Finer Particle Sizes than the Examples in Example 1C Show

By simply changing the gear ratio and screen hole size, finer particle sizes are easily achievable, at the expense of proportionately longer cycle times. Thus this type of machine is easily adapted to such needs. In the above examples the machine outputs "dust" as residue, yet could easily be modified to produce a fine-powder residue, similar to talcum powder.

EXAMPLE 2

In this example, the machine of Example 1, which was designed for cutting optical media disks by having a position setting of the cut bar near but not at zero clearance, is modified for instead cutting paper, by setting the position of the cut bar to zero clearance.

EXAMPLE 2A

In this example, the machine of Example 1 is modified, by using a sacrificial cut bar.

EXAMPLE 3

A machine (InfoStroyer™ 151) was constructed, and the machine has the following specifications:

INTENDED USE: Highest Security Terminal Destruction of all types of optical media—CD, DVD, BLU-RAY, both Recordable and Pre-Recorded, data per U.S. Dept. of Defense Specifications, Standards, and Requirements.

MACHINE SIZE (With no Internal Vacuum Option, L×W×H): 11.5×9.4×7.8" (292×239×198 mm)

NET WEIGHT: 14.8 lbs. (6.72 kg)

POWER REQUIRED: 110-130 VAC 50-60 Hz, 10 Amp Supply Recommended.

FUSE: 10 Amp Slow-Blow

VACUUM LEVEL REQUIRED (whether using Internal Vac Option or Externally Provided Vacuum): At least 10" WC suction. Equivalent to: 18.7 mmHg or 0.361 PSI suction Type of RESIDUE OUTPUT: Dust CYCLE TIME: Approximately 7 seconds per disc.

LUBRICATION REQUIRED: None

CONSUMABLES REQUIRED: None

Example 3A

The machine of Example 3 is being DOD-Evaluated for all types of the following OPTICAL MEDIA:

1. Compact Disc ("CD"), Recordable CD ("CD-R"), Rewritable CD ("CD-RW")
2. DVD—both pre-Recorded and Recordable ("DVD-R", "DVD-RW")
3. Blu-Ray Discs ("BD"), both Pre-Recorded and Recordable.

The machine COMPLETELY DESTROYS the DISC, along with the data.

EXAMPLE 3B

Optional equipment with respect to the machine of Example 3 is:

1. Internal Vacuum Option
2. Transport Case
3. Emergency CD Converter (for 12-volt vehicle battery operation)

EXAMPLE 3C

A customer is instructed to initially set-up the machine of Example 3 is as follows:

The machine is for use on a stable surface, such as a desk or table. The power required is typically, approximately 6-8 amps @ 115 VAC @ 60 Hz (approx. 920 watts). Starting surge is briefly higher. Check data plate (rear of machine). Make sure power source matches requirements on data plate.

1. Set the front-panel rocker switch to the "OFF" position.
2. Plug the machine into a GROUNDED outlet.
3. Unless equipped with Internal Vacuum Option: Connect a suitable shop-type vacuum with a standard 1¼" nozzle, to the Residue Outlet, rear of machine. Maximum Penetration into the Outlet: 3" (76 mm)

NOTE: If Vacuum is too weak, this machine will not operate. This is usually due to a full bag or full vacuum canister.

Operator Controls:

1. Power Switch: Switches all power to the machine ON and OFF.
2. "LOW VAC or BAG FULL" LAMP: indicates not enough vacuum suction is present for proper operation. When lit, machine will not process discs, or run manually.
3. "RUN MANUAL" Button: Press this button to run manually.

Normal (Automatic Operation:

1. Set POWER SWITCH to ON ("I") position. [NOTE: internal cooling fan may quietly run whenever Switch is ON, depending on configuration. Thus, if the machine is to be used frequently, it is perfectly OK to simply leave the SWITCH in the "ON" position.]
2. Switch ON Vacuum unit (if configured for External Vacuum). NOTE: Internal Vacuum Sensor disables operation if sufficient Vacuum is not present. Vacuum must be running properly and be connected to the rear Residue Port.
3. Remove sticky labels from disc before processing, if practicable. Failure to do this MAY gum-up the cutter or Drive Roll. If you are unable to remove labels, insert disc with label facing you, to reduce the chance of cutter gum-up.
4. Firmly insert the disc to be destroyed all the way into the slot. The machine will automatically start during this loading process. Continue inserting the disc until machine starts pulling disc downward. The machine will stop automatically when destruction is finished.
5. If you have been running a lot of discs, and fan is running, let the machine cool down for about 5 minutes before switching power off.

Manual Operation:

If you need to process part of a broken disc:

1. Power Switch ON.
2. External Vacuum ON.
3. Insert the disk fragment and press the "RUN MANUAL" Button. This bypasses the internal disc-detect switch, which might not be triggered if the disk fragment does not pass by it.
4. Hold "RUN MANUAL" Button down until destruction is complete. You will hear a change in the sound when complete.

NOTE: Machine will NOT run, even Manually, if sufficient Vacuum is not present.

Vacuum must be running properly and be connected to the machine.

EXAMPLE 3D

An Internal Vacuum machine is constructed, repeating the internal parts of the External Vacuum version, plus adding a vacuum unit and bag built in, with a larger enclosure to accommodate bag and vacuum unit.

EXAMPLE 4

A preferred example of a gear system for use in the invention is illustrated in FIGS. 8A-8D, 9A-9D, 10A-10D, directed to a gear system for positive gear mesh retention, with seal integrity, lubrication, and cooling features. This gear system drives the feed of load into cutter 2 in a controlled manner.

Power Flow.

Herein, I use terminology as follows: "Worm" refers to the driving element of a worm/wormgear pair. It is always herein designated with the letter "W".

"Wormgear" refers to the DRIVEN element of a worm/wormgear pair. It is always herein designated with the letters "WG".

Note: In general (except in cases of EXTREMELY low drive rations), worms cannot be "back-driven" by wormgears, due to the inherent pressure geometry of worm/wormgear pairs. Thus a worm is always the DRIVING element of such a pair, unless the helix angle of the set is extraordinarily large, with an extremely low drive ratio.

POWER FLOW is as follows: (FIGS. 8A & 10A-10D) Worm W1 is driven by the end of the cutter shank, which is driven from the other end of the cutter by an electric motor. It drives wormgear WG1. Wormgear WG1 is on a common shaft with worm W2. Worm W2 drives wormgear W2 (FIG. 8A), which is on a common shaft with the pinch roll. The pinch roll feeds the disk towards the cutter.

The gear system illustrated in FIGS. 10A-12D addresses the following technical challenge and requirements:

1. Proper operation of this machine requires that a worm or helical gear set must CONSTANTLY remain in proper full mesh, while one rotating element is also translating horizontally, by varying amounts of translation. This constant meshing is required by the design because the driven element must also be constrained from rotating beyond the amount generated by the gears driving it. In other words, it must drive the load to feed it, but also must keep the load from running further than driven (such as from the cutter tending to grab the disc and self-feed), so as to prevent overload. The generally non-back-driving character of wormgear sets is thus exploited. This general design problem is further complicated by the requirement for constant lubrication and cooling, partly due to the notorious inefficiency of worm gear sets. Worm and helical gear sets (especially worm gears) generate a lot of heat due to sliding friction. However, in exchange for accepting for this notorious inefficiency, worm gear sets provide extremely high reduction ratios in a very compact and inexpensive gear set design.

2. The gear set must remain constantly lubricated.

3. The gear set must be cooled.

4. The gear set must be inexpensive, simple, compact, and easy to assemble.

All four of these objectives are met by a gearbox A) comprising a sliding, sealed bearing (BR2 in FIG. 8D) for the rotating/translating shaft driven by WG2; B) wherein the gearbox itself rotates about a point (center of W1, FIG. 10A-10C) determined by the gear set geometry.

The constraints and operating principle are as follows.

First, in order to obtain proper mesh at the pitch lines of the gear sets, the worm gear's center must be kept a constant perpendicular distance from a line (L1 in FIGS. 10A-10C) centered along the mating worm's axis of rotation. It follows that the wormgears center (at WG2's) must be made to ALWAYS fall on another line which is PARALLEL to the worm's (W2's) axis of rotation.

Second, meanwhile, the other gear elements (W1-WG1) must ALSO remain constantly in mesh.

The invention provides as follows:

1) The worm GEAR's (WG2's) center is captured by a sliding bearing (BRG2) whose path always falls on such a PARALLEL line at a constant distance from L1.

2) This is accomplished by fashioning a precisely defined Bearing Pocket (BP1) for the worm GEAR'S bearing (BRG2), this Pocket being so dimensioned as to allow BRG2 to slide along this PARALLEL line, AND ONLY along this PARALLEL line. The Pocket width is just slightly greater than BRG2's outside diameter, to allow constrained sliding. (The axis of the Pocket slot, and thus the line of freedom of linear motion of BRG2 is PARALLEL to line L1).

3) The sliding action will occur naturally when the translating shaft moves laterally, so long as the MOUNT BASE (MB, FIG. 8D) for the gear set is free to rotate as required.

Figures 8A, 8B, 8C, 8D, 9A, 9B, 9C, 9D, 10A, 10B, 10C, 10D:
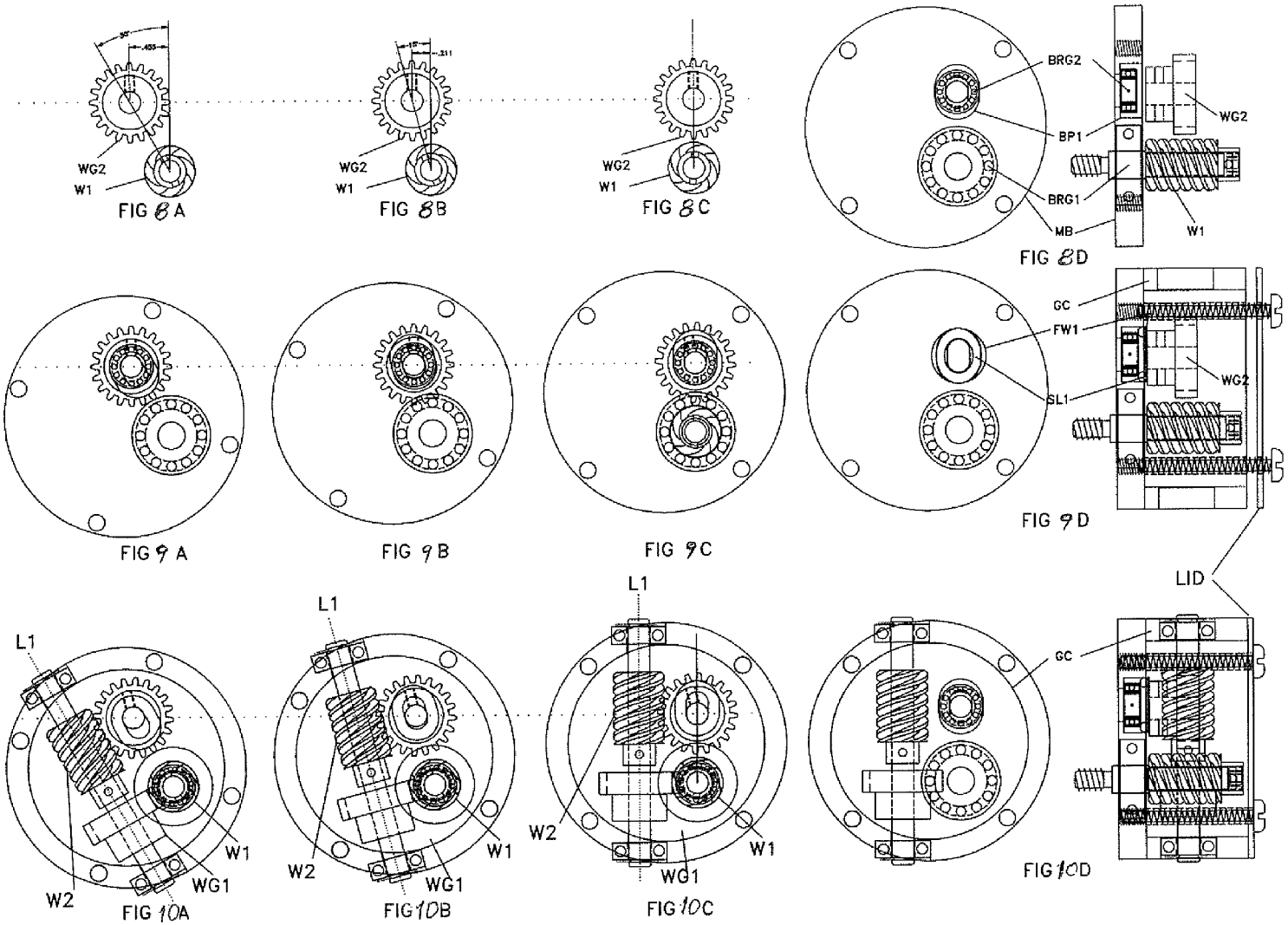
FIGS. 8A-8D, 9A-9D and 10A-10D are cross-sectionals views of gearbox assembly 23 according to an embodiment of the invention.

4) This MOUNT rotation freedom is accomplished by securing the Mount Base (MB) to the required center of rotation using another bearing (BRG1, FIG. 8D). This "proper center" occurs at center of Worm Gear W1. Worm W1 is the primary driving element. By using a bearing (BRG1) in the Mount Base (MB, FIG. 8D) for W1, W1 is allowed to rotate in normal driving operation, but the Mount Base ITSELF is ALSO allowed to rotate (actually, oscillate rotationally as necessary) about the center of W1. This geometry keeps W1 and WG1 constantly in proper mesh, regardless of angular position of the mounting base MB, while also keeping W2 and WG2 constantly in proper mesh, regardless of angular position of the mounting base MB.

5) SEALING to retain lubrication and prevent contamination of gears and bearings is accomplished as follows: All bearings used are conventional sealed-type bearings. The sliding bearing (BRG2) is thus also a sealed-type bearing, but because it slides in the Pocket (BP1), additional sealing is required between bearing and Pocket. The solution provided herein is that a conventional flexible O-Ring is size-selected such that its normal circular outer diameter is slightly distorted into an oval shape during installation, and thus snugly fits into the oval cavity of BP1. This seal (SL1, FIG. 9D) is retained in place and slightly compressed by a smooth flat washer (FW1, FIG. 9D), located between the hub face of Worm Gear WG2 and the seal (SL1).

In summary, the assembly of this example forces all gears to remain constantly in proper full mesh, while allowing the lateral translation of WG2, along with driven rotation of WG2. Sealing is provided so that lubricating grease, which partially fills the gearbox cavity, can both lubricate the gears and transmit heat to the Gear Case (GC, FIG. 9D), which is cylindrical, in the present example, but could be of any suitable shape.

Advantageous features of the inventive gear assembly are as follows. Advantageously, the position of the sliding bearing within the gearbox is driven by the lateral position of the translating shaft. Advantageously, the seal of the sliding bearing, PLUS a seal for the sliding pocket for the bearing, plus other conventional seals retain the lubricant within the gearbox. Advantageously, the lubricant transmits heat generated by the gears to the outside walls of the gearbox. Advantageously, the design is extremely economical as to minimal use of physical volume; simplicity of manufacture; and minimal component cost.

EXAMPLE 4A

Speed Reduction

The specification chosen for the constructed gear assembly of Example 4 was for a speed reduction of about 100:1 from drive shaft to driven shaft.

By careful selection of the types of worm gears used, the reduction ratio can be much greater or much smaller.

If the overall reduction ratio has a square root which is an integer, the design can be implemented with two identical worms and two identical worm gears, thus achieving economies due to commonality of parts.

In one example according to FIGS. 8A-10D that has been actually implemented, a ratio of 100:1 was achieved using two 20-tooth, double-lead worm gears along with two double-lead worms, providing an extremely compact, economical design. (As is well-known in the art, a double-lead worm gear, used an appropriate worm, provides a reduction of ½ the number of teeth. A triple-lead worm gear provides a reduction of ⅓ the number of teeth. A quadruple-lead worm gear provides a reduction of ¼ the number of teeth, etc. The example's 20-tooth double-lead worm gear with matching worm provides a 10:1 ratio.)

Other economical ratios:

400:1 using two sets of 20-tooth single-lead worm gears and worms (20×20)

81:1 using two sets of using 18-tooth double-lead worm gears and worms (9×9)

64:1 using two sets of 16-tooth double-lead worm gears and worms (8×8)

If a combination of single-lead, double-lead and/or quadruple-lead worm gear sets are used, the available ratios provide an extremely wide range of economical design choices.

EXAMPLE 5

A driven gear WG2 can be constructed to have a considerably greater range and type of lateral motion than used in Example 4.

Referring to FIGS. 11A-11E, a range of possible positions of WG2 is determined by the center-to-center distance (dimension D1, FIGS. 11C & 12A) between the Pocket arc extremes (PE1 and PE2), combined with the distances from W1 to the two Pocket arc extremes.

By (a) strategically fixing W2's position on its shaft and (b) increasing the length of the Pocket BP1, the range of possible fully-meshed positions of WG2 is significantly increased.

FIGS. 11A-11E show such a configuration, with a range of 60 degrees of Gearbox rotation, shown at 15-degree intervals, arbitrarily chosen for purposes of illustration.

The dotted lines in 11A-11E show one of many possible paths of WG2 during this 60-degree rotation of the Gear Case's Mounting Base MB about W1's center. The upper dotted line is a possible path, given the angular position of MB. The lower dotted line is a "base line" for comparison.

Note that the upper line is not parallel to the base line. The upper line could also be curved, provided that MB's angular position followed as necessary.

Please note further, that constraints on the possible positions of WG2 are greatly relaxed.

EXAMPLE 5A

Referring to FIGS. 12A-12C, the geometric and mechanical consequences of FIGS. 11A-11E are illustrated.

WG2 can be in full mesh with W2 if WG2's center lies anywhere on or between the two circles C1 and C2, provided only that the gearbox body, attached to MB, is free to rotate about the center of W1 as necessary.

NOTE: Circles C1 and C2 are both drawn centered on W1, with C1 passing through the centers of PE1, and C2 passing through the center of PE2.

NOTE: If W2 is made as a longer worm, the distance D1 can be made longer to match. This would make the radius of C2 commensurately larger, and hence the range of possible fully-meshed positions of WG2 is similarly commensurately increased.

EXAMPLE 5B

Applications

A sliding roll drive is one example for the technology illustrated in FIGS. 11A-12C.

Additionally, there is broad applicability for the technology illustrated with reference to FIGS. 11A-12C in many types of mechanisms, with both helical and worm gear sets, in situations where a driven shaft must be allowed to be centered in unpredictable locations within a known range of possible locations.

EXAMPLE 6

Weight

An inventive non-vacuum-version production unit machine has been constructed that has weight of 14.8 lbs.

EXAMPLE 6A

Weight

An internal-vac-version machine is estimated to have a weight under 20 lbs., depending on a residue capacity that is selected.

While the invention has been described in terms of a preferred embodiment, those skilled in the art will recognize that the invention can be practiced with modification within the spirit and scope of the appended claims.

What I claim as my invention is:

1. A rotary cutter system in which is destroyed an optical media disk that enters via controlled feed, comprising:

a cutter that is a burr, wherein the cutter is driven by a motor configured for variable speed operation depending on what part of the disk diameter-wise is presented to the cutter, configured (1) for fast operation when the disk first enters and only a small portion diameter-wise is presented to the cutter, (2) to slow as a biggest diameter portion of the disk reaches the cutter, and (3) to gradually speed up as the disk midpoint is passed;

and wherein the cutter has a length of about 5 inches;

a screen wrapped around the cutter without the screen touching the cutter.

2. The system of claim 1 wherein the cutter comprises a 16-tooth burr with a helical diamond pattern thereon.

3. The rotary cutter system of claim 1, wherein the cutter comprises a staggered-pattern cutter.

4. The rotary cutter system of claim 3, wherein the staggered-pattern cutter is patterned with a dual-helical diamond pattern which is a staggered-pattern having two spiral angles.

5. The rotary cutter system of claim 1, further comprising a cut bar pivot limit mechanism, positioned whereby zero-clearance between the cutter and a cut bar is maintained.

6. The rotary cutter system of claim 1, wherein the cutter comprises a shaft ending, wherein the shaft ending is polygonal shaped.

7. The rotary cutter system of claim 1, further comprising a cut bar in zero-clearance arrangement with the cutter.

8. The rotary cutter system of claim 1, wherein the wrapped screen has about $^{15}/_{1,000}$ of an inch radial clearance from the burr.

9. The rotary cutter system of claim 1, wherein a radial clearance between the wrapped screen and the cutter is in a range of about $^{5}/_{1,000}$ to $^{30}/_{1,000}$ of an inch.

10. The rotary cutter system of claim 1, wherein the screen is wrapped around the cutter spanning more than 180 degrees of the cutter.

11. The rotary cutter system of claim 1, wherein the screen is wrapped around the cutter spanning more than 270 degrees of the cutter.

* * * * *